US011523231B2

(12) United States Patent
Recker et al.

(10) Patent No.: US 11,523,231 B2
(45) Date of Patent: Dec. 6, 2022

(54) METHODS AND SYSTEMS FOR ASSESSING INSERTION POSITION OF HEARING INSTRUMENT

(71) Applicant: Starkey Laboratories, Inc., Eden Prairie, MN (US)

(72) Inventors: Karrie Recker, Edina, MN (US); Jumana Harianawala, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 17/139,171

(22) Filed: Dec. 31, 2020

(65) Prior Publication Data

US 2021/0204074 A1 Jul. 1, 2021

Related U.S. Application Data

(63) Continuation-in-part of application No. PCT/US2020/065122, filed on Dec. 15, 2020.

(60) Provisional application No. 62/955,798, filed on Dec. 31, 2019.

(51) Int. Cl.
*H04R 25/00* (2006.01)

(52) U.S. Cl.
CPC ..... *H04R 25/407* (2013.01); *H04R 25/405* (2013.01); *H04R 25/50* (2013.01); *H04R 2460/01* (2013.01)

(58) Field of Classification Search
CPC ..... H04R 25/00; H04R 25/60; H04R 25/65; H04R 2225/023; H04R 2225/025
See application file for complete search history.

(56) References Cited

U.S. PATENT DOCUMENTS

| | | | |
|---|---|---|---|
| 5,825,894 | A | 10/1998 | Shennib |
| 5,923,764 | A | 7/1999 | Shennib |
| 7,660,426 | B2 | 2/2010 | Hannibal et al. |
| 8,165,329 | B2 | 4/2012 | Bisgaard |
| 9,107,586 | B2 | 8/2015 | Tran |
| 9,445,768 | B2 | 9/2016 | Alexander et al. |
| 9,516,438 | B2 | 12/2016 | Andersen et al. |

(Continued)

FOREIGN PATENT DOCUMENTS

| | | |
|---|---|---|
| DK | 1703770 T3 | 6/2017 |
| EP | 2813175 A2 | 6/2014 |

(Continued)

OTHER PUBLICATIONS

Invitation to Restrict or Pay Additional Fees from International Application No. PCT/US2020/065122, dated Mar. 2, 2021, 16 pp.

(Continued)

*Primary Examiner* — Suhan Ni
(74) *Attorney, Agent, or Firm* — Shumaker & Sieffert, P.A.

(57) ABSTRACT

A speaker of a hearing instrument generates a sound that includes a range of frequencies. Furthermore, a microphone of the hearing instrument measures an acoustic response to the sound. A processing system classifies, based on the acoustic response to the sound, a depth of insertion of an in-ear assembly of the hearing instrument into an ear canal of a user. Additionally, the processing system generates an indication based on the depth of insertion of the in-ear assembly of the hearing instrument into the ear canal of the user.

22 Claims, 6 Drawing Sheets

(56) References Cited

U.S. PATENT DOCUMENTS

| | | | | |
|---|---|---|---|---|
| 9,596,551 | B2 | 3/2017 | Pedersen et al. | |
| 9,860,650 | B2 | 1/2018 | Burger et al. | |
| 9,860,653 | B2 | 1/2018 | Olsen et al. | |
| 9,900,712 | B2 | 2/2018 | Galster et al. | |
| 10,219,069 | B2 | 2/2019 | Urup et al. | |
| 10,341,784 | B2 | 7/2019 | Recker et al. | |
| 2010/0067722 | A1 | 3/2010 | Bisgaard | |
| 2010/0142739 | A1* | 6/2010 | Schindler | H04R 25/00 381/329 |
| 2010/0239112 | A1* | 9/2010 | Howard | H04R 25/00 381/329 |
| 2010/0253505 | A1 | 10/2010 | Chou | |
| 2011/0091058 | A1 | 4/2011 | Sacha et al. | |
| 2011/0238419 | A1 | 9/2011 | Barthel | |
| 2011/0261983 | A1 | 10/2011 | Claussen et al. | |
| 2012/0101514 | A1 | 4/2012 | Keady et al. | |
| 2013/0216434 | A1 | 8/2013 | Ow-wing | |
| 2015/0110323 | A1 | 4/2015 | Sacha | |
| 2015/0222821 | A1 | 8/2015 | Shaburova et al. | |
| 2016/0166203 | A1* | 6/2016 | Goldstein | H04R 25/00 600/509 |
| 2016/0309266 | A1 | 10/2016 | Olsen et al. | |
| 2017/0258329 | A1 | 9/2017 | Marsh | |
| 2018/0014784 | A1 | 1/2018 | Heeger et al. | |
| 2019/0076058 | A1 | 3/2019 | Piechowiak | |
| 2019/0110692 | A1 | 4/2019 | Pardey et al. | |
| 2021/0014619 | A1 | 1/2021 | Sacha et al. | |
| 2022/0109925 | A1 | 4/2022 | Xue et al. | |

FOREIGN PATENT DOCUMENTS

| | | | |
|---|---|---|---|
| EP | 2908550 | B1 | 8/2015 |
| EP | 3086574 | A2 | 4/2016 |
| EP | 3113519 | A1 | 6/2016 |
| EP | 3448064 | A1 | 8/2018 |
| JP | 2009232298 | A | 10/2009 |
| KR | 20000029582 | A | 5/2000 |
| WO | 198901315 | A1 | 2/1989 |
| WO | 2010049543 | A2 | 5/2010 |
| WO | 2012149955 | A1 | 8/2012 |
| WO | 2012044278 | A1 | 4/2021 |
| WO | 2022066307 | A2 | 3/2022 |

OTHER PUBLICATIONS

Chan et al., "Estimation of eardrum acoustic pressure and of ear canal length from remote points in the canal", Journal of the Acoustical Society of America, vol. 87, No. 3, Mar. 1990, pp. 1237-1247.

Convery et al., "Management of Hearing Aid Assembly by Urban-Dwelling Hearing-Impaired Adults in a Developed Country: Implications for a Self-Fitting Hearing Aid", Trends in Amplification, vol. 15, No. 4, Dec. 26, 2011, pp. 196-208.

Convery, "Factors Affecting Reliability and Validity of Self-Directed Automatic In Situ Audiometry: Implications for Self-Fitting Hearing Aids", Journal of the American Academy of Audiology, vol. 26, No. 1, Jan. 2015, 15 pp.

Ebpman Tech Reviews, "New! Nuheara IQbuds Boost Now with Ear ID—NAL/NL2 Detailed Review", YouTube video retrieved Aug. 7, 2019, from https://www youtube.com/watch?v=AizU7PGVX0A, 1 pp.

Jerger, "Studies in Impedance Audiometry, 3. Middle Ear Disorders," Archives Otolaryngology, vol. 99, Mar. 1974, pp. 164-171.

Kruger, "An Update on the External Ear Resonance in Infants and Young Children," Ear & Hearing, vol. 8. No. 6, Applicant points out, in accordance with MPEP 609.04(a), that the year of publication, 1987, is sufficiently earlier than the effective U.S. filing date, so that the particular month of publication is not in issue.), 1987, pp. 333-336.

Kruger, "The Acoustic Properties of the Infant Ear, A preliminary report," Acta Otolaryngology, vol. 103, No. 5-6, May-Jun. 1987, pp. 578-585.

Anderson et al., "Tech Adoption Climbs Among Older Adults", Pew Research Center: Internet and Technology, accessed from: http://www.pewinternet.org/2017/05/17/technology-use-among-seniors/, May 2017, 23 pp.

Recker, "Using Average Correction Factors to Improve the Estimated Sound Pressure Level Near the Tympanic Membrane", Journal of the American Academy of Audiology, vol. 23, (Applicant points out, in accordance with MPEP 609.04(a), that the year of publication, 2012, is sufficiently earlier than the effective U.S. filing date, so that the particular month of publication is not in issue.), 2012, pp. 733-750.

Salvinelli, "The external ear and the tympanic membrane, A Three-dimensional Study," Scandinavian Audiology, vol. 20, No. 4, (Applicant points out, in accordance with MPEP 609.04(a), that the year of publication, 1991, is sufficiently eadier than the effective U.S filing date, so that the particular month of publication is not in issue), 1991, pp. 253-256.

Strom, "Hearing Review Survey of RIC Pricing in 2017", Hearing Review, vol. 25, No. 3, Mar. 21, 2018, 8 pp.

Sullivan, "A Simple and Expedient Method to Facilitate Receiver-in-Canal (RIC) Non-custom Tip Insertion", Hearing Review, vol. 25, No. 3, Mar. 5, 2018, 5 pp.

"Mobile Fact Sheet," Pew Research Center: Internet and Technology, accessed from: http://www.pewinternet.org/fact-sheet/mobile/, retrieved from https://web.archive.org/web/20191030053637/https://www.pewresearch.org/internet/fact-sheet/mobile/, Jun. 2019, 4 pp.

International Search Report and Written Opinion from International Application No. PCT/US2020/065122, dated Apr. 30, 2021, 22 pp.

"How to Put on a Hearing Aid", Windex, Oct. 26, 2016, 7 pages.

Boothroyd, "Adult Aural Rehabilitation: What Is It and Does It Work?", vol. 11 No. 2, Jun. 2007, pp. 63-71.

Convery et al., "A Self-Fitting Hearing Aid: Need and Concept", Trends in Amplification, Dec. 4, 2011, pp. 157-166.

Gregory et al. "Experiences of hearing aid use among patients with mild cognitive impairment and Alzheimer's disease dementia: A qualitative study", SAGE Open Medicine, vol. 8, Mar. 3, 2020, pp. 1-9.

Keidser et al., "Self-Fitting Hearing Aids: Status Quo and Future Predictions", Trends in Hearing, vol. 20, Apr. 12, 2016, pp. 1-15.

McCormack et al., "Why do people fitted with hearing aids not wear them?", International Journal of Audiology, vol. 52, May 2013, pp. 360-368.

Powers et al., "MarkeTrak 10: Hearing Aids in an Era of Disruption and DTC/OTC Devices", Hearing Review, Aug. 2019, pp. 12-20.

U.S. Appl. No. 62/939,031, filed Nov. 22, 2019, naming inventors Xue et al.

U.S. Appl. No. 63/194,658, filed May 28, 2021, naming inventors Griffin et al.

Wong et al., "Hearing Aid Satisfaction: What Does Research from the Past 20 Years Say?", Trends In Amplification, vol. 7, Issue 4, Jan. 1, 2003, pp. 117-161.

* cited by examiner

METHODS AND SYSTEMS FOR ASSESSING INSERTION POSITION OF HEARING INSTRUMENT

This application is a continuation-in-part of PCT application PCT/US2020/065122, filed Dec. 15, 2020, which claims the benefit of U.S. Provisional Patent Application 62/955,798, filed Dec. 31, 2019, the entire content of each of which is incorporated by reference.

TECHNICAL FIELD

This disclosure relates to hearing instruments.

BACKGROUND

Hearing instruments are devices designed to be worn on, in, or near one or more of a user's ears. Common types of hearing instruments include hearing assistance devices (e.g., "hearing aids"), earphones, headphones, hearables, and so on. Some hearing instruments include features in addition to or in the alternative to environmental sound amplification. For example, some modern hearing instruments include advanced audio processing for improved device functionality, controlling and programming the devices, and beamforming, and some can communicate wirelessly with external devices including other hearing instruments (e.g., for streaming media).

SUMMARY

This disclosure describes techniques for verifying correct insertion of in-ear assemblies of hearing instruments into ear canals of users. As described herein, a speaker of a hearing instrument may generate a sound directed into an ear canal of a user of the hearing instrument. The sound includes a range of frequencies. Furthermore, a microphone of the hearing instrument measures an acoustic response to the sound. A processing system classifies, based on the acoustic response to the sound, a depth of insertion of an in-ear assembly of the hearing instrument into the ear canal of the user. Additionally, the processing system may generate an indication based on the depth of insertion of the in-ear assembly of the hearing instrument into the ear canal of the user.

In one example, this disclosure describes a method for fitting a hearing instrument, the method comprising: generating, by a speaker of the hearing instrument, a sound that includes a range of frequencies; measuring, by a microphone of the hearing instrument, an acoustic response to the sound; classifying, by a processing system, based on the acoustic response to the sound, a depth of insertion of an in-ear assembly of the hearing instrument into an ear canal of a user; and generating an indication based on the depth of insertion of the in-ear assembly of the hearing instrument into the ear canal of the user.

In another example, this disclosure describes a system comprising: a speaker of a hearing instrument, the speaker configured to generate a sound that includes a range of frequencies; a microphone of the hearing instrument, wherein the microphone is configured to measure an acoustic response to the sound; and one or more processors implemented in circuitry, the one or more processors configured to: classify, based on the acoustic response to the sound, a depth of insertion of an in-ear assembly of the hearing instrument into an ear canal of a user; and generate an indication based on the depth of insertion of the in-ear assembly of the hearing instrument into the ear canal of the user.

In another example, this disclosure describes a method for fitting a hearing instrument, the method comprising: classifying, by a processing system, based on an acoustic response measured by a microphone of the hearing instrument to a sound generated by a speaker of the hearing instrument, a depth of insertion of an in-ear assembly of the hearing instrument into an ear canal of a user, wherein the sound includes a range of frequencies; and generating an indication based on the depth of insertion of the in-ear assembly of the hearing instrument into the ear canal of the user.

The details of one or more aspects of the disclosure are set forth in the accompanying drawings and the description below. Other features, objects, and advantages of the techniques described in this disclosure will be apparent from the description, drawings, and claims.

DETAILED DESCRIPTION

Figure 1:
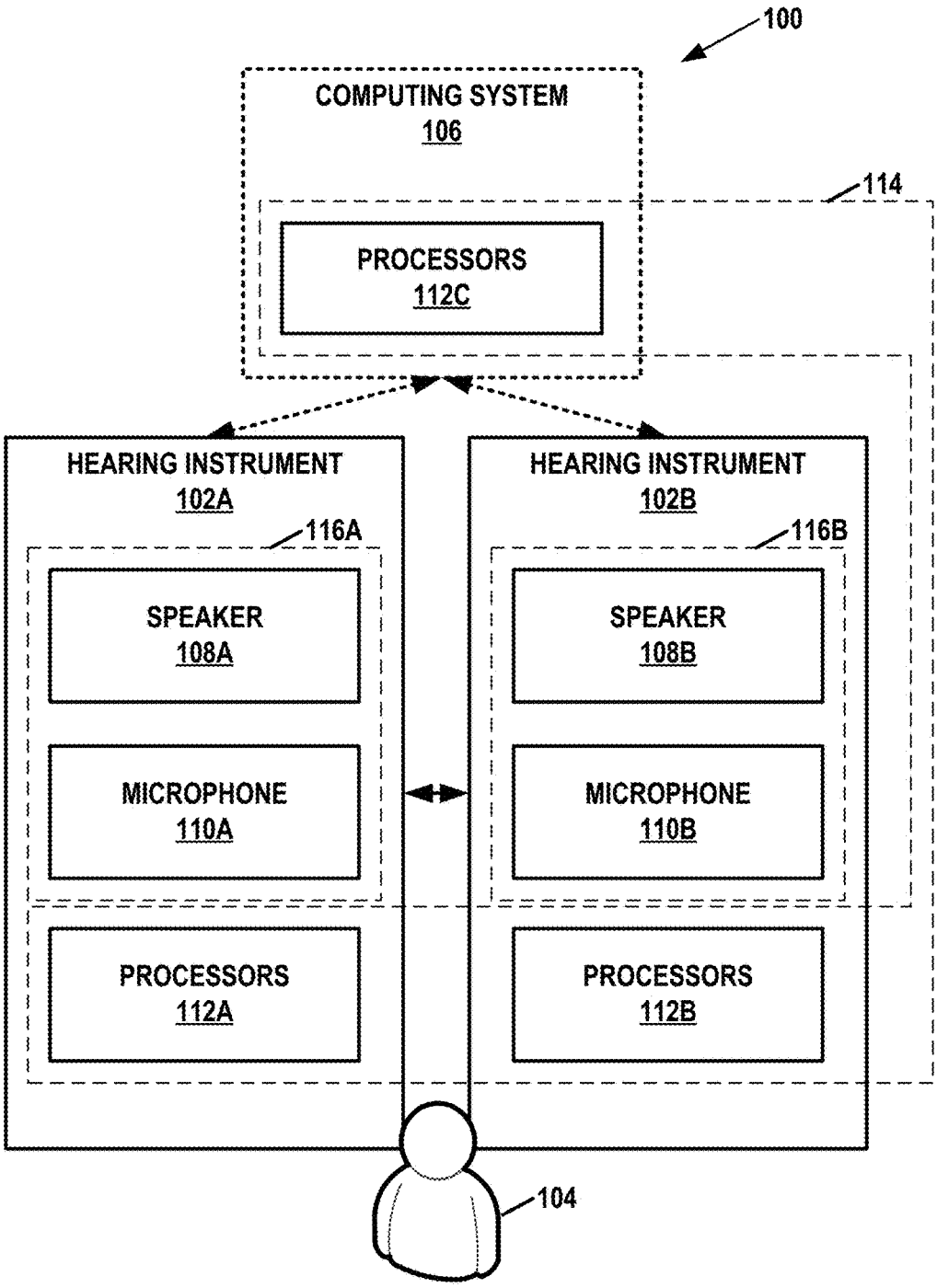
FIG. 1 is a conceptual diagram illustrating an example system that includes one or more hearing instruments, in accordance with one or more aspects of this disclosure.

Recent legislation will allow for the sale of over-the-counter (OTC) and direct-to-consumer (DTC) hearing instruments, such as hearing aids, to adults with mild-to-moderate hearing loss. Thus, users of such hearing instruments may need to correctly place in-ear assemblies of hearing instruments in their own ear canals without help from hearing professionals. However, correct placement of an in-ear assembly of a hearing instrument in a user's own ear canal may be difficult. It may be especially difficult to correctly place in-ear assemblies of receiver-in-the-canal (RIC) hearing instruments, which make up approximately 69% of hearing aids sold in the United States.

The most common problem with placing in-ear assemblies of hearing instruments in users' ear canals is that the users do not insert the in-ear assemblies of the hearing instruments far enough into their ear canals. A user's experience can be negatively impacted by not inserting an in-ear assembly of a hearing instrument far enough into the user's ear canal. For example, when a user does not insert the in-ear assembly of their hearing instrument far enough into the user's ear canal, the hearing instrument may look bad cosmetically, may cause the hearing instrument to be less comfortable physically, and may cause retention issues (e.g., the in-ear assembly of the hearing instrument may fall out and be lost).

In another example of a negative impact caused by a user not inserting an in-ear assembly of a hearing instrument far enough into the user's ear canal, under-insertion of the in-ear assembly of the hearing instrument into the user's ear canal may cause hearing thresholds to be overestimated if the hearing thresholds are measured when the in-ear assembly of the hearing instrument is not inserted far enough into the user's ear canal. Overestimation of the user's hearing thresholds may cause the hearing instrument to provide more gain than the hearing instrument otherwise would if the in-ear assembly of the hearing instrument were properly inserted into the user's ear canal. In other words, the hearing instrument may amplify sounds from the user's environment more if the in-ear assembly of the hearing instrument was under-inserted during estimation of the user's hearing thresholds. Providing higher gain may increase the likelihood of the user perceiving audible feedback. Additionally, providing higher gain may increase power consumption and reduce battery life of the hearing instrument.

In another example of a negative impact caused by a user not inserting an in-ear assembly of a hearing instrument far enough into the user's ear canal, if the user's hearing thresholds were estimated using a transducer other than a transducer of the hearing instrument (e.g., using headphones) and the hearing instrument is programmed to use these hearing thresholds, the hearing instrument may not provide enough gain. In other words, the user's hearing threshold may be properly estimated, and the hearing instrument may be programmed with the proper hearing thresholds; but the resulting gain provided by the hearing instrument may not be enough for the user if the in-ear assembly of the hearing instrument is not placed far enough into the user's ear canal. As a result, the user may not be satisfied with the level of gain provided by the hearing instrument.

This disclosure describes techniques that may overcome one or more of the issues mentioned above. As described herein, a hearing instrument includes a speaker and a microphone. The speaker and/or the microphone may be included in an in-ear assembly of the hearing instrument. The in-ear assembly of the hearing instrument is designed for complete or partial insertion into an ear canal of the user of the hearing instrument. The speaker is configured to generate a sound directed into an ear canal of the user. The sound includes a range of frequencies. The microphone is configured to detect sounds from the ear canal of the user. Thus, both the speaker and the microphone may face into the user's ear canal. The microphone is configured to measure an acoustic response to the sound. A processing system may classify, based on the acoustic response to the sound, a depth of insertion of the in-ear assembly of the hearing instrument in the ear canal of the user. Additionally, the processing system may generate an indication based on the depth of insertion of the in-ear assembly of the hearing instrument into the ear canal of the user. Thus, in some examples, the user may receive an indication of whether the in-ear assembly of the hearing instrument is inserted sufficiently far into the user's ear canal.

FIG. 1 is a conceptual diagram illustrating an example system 100 that includes hearing instruments 102A, 102B, in accordance with one or more aspects of this disclosure. This disclosure may refer to hearing instruments 102A and 102B collectively, as "hearing instruments 102." A user 104 may wear hearing instruments 102. In some instances, such as when user 104 has unilateral hearing loss, user 104 may wear a single hearing instrument. In other instances, such as when user 104 has bilateral hearing loss, the user may wear two hearing instruments, with one hearing instrument for each ear of user 104.

Hearing instruments 102 may comprise one or more of various types of devices that are configured to provide auditory stimuli to user 104 and that are designed for wear and/or implantation at, on, or near an ear of user 104. Hearing instruments 102 may be worn, at least partially, in the ear canal or concha. In any of the examples of this disclosure, each of hearing instruments 102 may comprise a hearing assistance device. Hearing assistance devices include devices that help a user hear sounds in the user's environment. Example types of hearing assistance devices may include hearing aid devices, Personal Sound Amplification Products (PSAPs), and so on. In some examples, hearing instruments 102 are over-the-counter, direct-to-consumer, or prescription devices. Furthermore, in some examples, hearing instruments 102 include devices that provide auditory stimuli to user 104 that correspond to artificial sounds or sounds that are not naturally in the user's environment, such as recorded music, computer-generated sounds, sounds from a microphone remote from the user, or other types of sounds. For instance, hearing instruments 102 may include so-called "hearables," earbuds, earphones, or other types of devices. Some types of hearing instruments provide auditory stimuli to user 104 corresponding to sounds from the user's environment and also artificial sounds.

In some examples, one or more of hearing instruments 102 includes a housing or shell that is designed to be worn in the ear for both aesthetic and functional reasons and encloses the electronic components of the hearing instrument. Such hearing instruments may be referred to as in-the-ear (ITE), in-the-canal (ITC), completely-in-the-canal (CIC), or invisible-in-the-canal (IIC) devices. In some examples, one or more of hearing instruments 102 may be behind-the-ear (BTE) devices, which include a housing worn behind the ear that contains electronic components of the hearing instrument, including the receiver (e.g., a speaker). The receiver conducts sound to an earbud inside the ear via an audio tube. In some examples, one or more of hearing instruments 102 may be receiver-in-canal (RIC) hearing-assistance devices, which include a housing worn behind the ear that contains electronic components and a housing worn in the ear canal that contains the receiver.

Hearing instruments 102 may implement a variety of features that help user 104 hear better. For example, hearing instruments 102 may amplify the intensity of incoming sound, amplify the intensity of certain frequencies of the incoming sound, translate or compress frequencies of the incoming sound, and/or perform other functions to improve the hearing of user 104. In some examples, hearing instruments 102 may implement a directional processing mode in which hearing instruments 102 selectively amplify sound originating from a particular direction (e.g., to the front of user 104) while potentially fully or partially canceling sound originating from other directions. In other words, a directional processing mode may selectively attenuate off-axis unwanted sounds. The directional processing mode may help users understand conversations occurring in crowds or other noisy environments. In some examples, hearing instruments 102 may use beamforming or directional processing cues to implement or augment directional processing modes.

In some examples, hearing instruments 102 may reduce noise by canceling out or attenuating certain frequencies. Furthermore, in some examples, hearing instruments 102 may help user 104 enjoy audio media, such as music or sound components of visual media, by outputting sound based on audio data wirelessly transmitted to hearing instruments 102.

Hearing instruments 102 may be configured to communicate with each other. For instance, in any of the examples of this disclosure, hearing instruments 102 may communicate with each other using one or more wirelessly communication technologies. Example types of wireless communication technology include Near-Field Magnetic Induction (NFMI) technology, a 900 MHz technology, a BLUETOOTH™ technology, a WI-FI™ technology, audible sound signals, ultrasonic communication technology, infrared communication technology, an inductive communication technology, or another type of communication that does not rely on wires to transmit signals between devices. In some examples, hearing instruments 102 use a 2.4 GHz frequency band for wireless communication. In examples of this disclosure, hearing instruments 102 may communicate with each other via non-wireless communication links, such as via one or more cables, direct electrical contacts, and so on.

As shown in the example of FIG. 1, system 100 may also include a computing system 106. In other examples, system 100 does not include computing system 106. Computing system 106 comprises one or more computing devices, each of which may include one or more processors. For instance, computing system 106 may comprise one or more mobile devices, server devices, personal computer devices, handheld devices, wireless access points, smart speaker devices, smart televisions, medical alarm devices, smart key fobs, smartwatches, smartphones, motion or presence sensor devices, smart displays, screen-enhanced smart speakers, wireless routers, wireless communication hubs, prosthetic devices, mobility devices, special-purpose devices, accessory devices, and/or other types of devices.

Accessory devices may include devices that are configured specifically for use with hearing instruments 102. Example types of accessory devices may include charging cases for hearing instruments 102, storage cases for hearing instruments 102, media streamer devices, phone streamer devices, external microphone devices, remote controls for hearing instruments 102, and other types of devices specifically designed for use with hearing instruments 102. Actions described in this disclosure as being performed by computing system 106 may be performed by one or more of the computing devices of computing system 106. One or more of hearing instruments 102 may communicate with computing system 106 using wireless or non-wireless communication links. For instance, hearing instruments 102 may communicate with computing system 106 using any of the example types of communication technologies described elsewhere in this disclosure.

Furthermore, in the example of FIG. 1, hearing instrument 102A includes a speaker 108A, a microphone 110A, and a set of one or more processors 112A. Hearing instrument 102B includes a speaker 108B, a microphone 110B, and a set of one or more processors 112B. This disclosure may refer to speaker 108A and speaker 108B collectively as "speakers 108." This disclosure may refer to microphone 110A and microphone 110B collectively as "microphones 110." Computing system 106 includes a set of one or more processors 112C. Processors 112C may be distributed among one or more devices of computing system 106. This disclosure may refer to processors 112A, 112B, and 112C collectively as "processors 112." Processors 112 may be implemented in circuitry and may comprise microprocessors, application-specific integrated circuits, digital signal processors, or other types of circuits.

As noted above, hearing instruments 102A, 102B, and computing system 106 may be configured to communicate with one another. Accordingly, processors 112 may be configured to operate together as a processing system 114. Thus, discussion in this disclosure of actions performed by processing system 114 may be performed by one or more processors in one or more of hearing instrument 102A, hearing instrument 102B, or computing system 106, either separately or in coordination.

Figure 2:
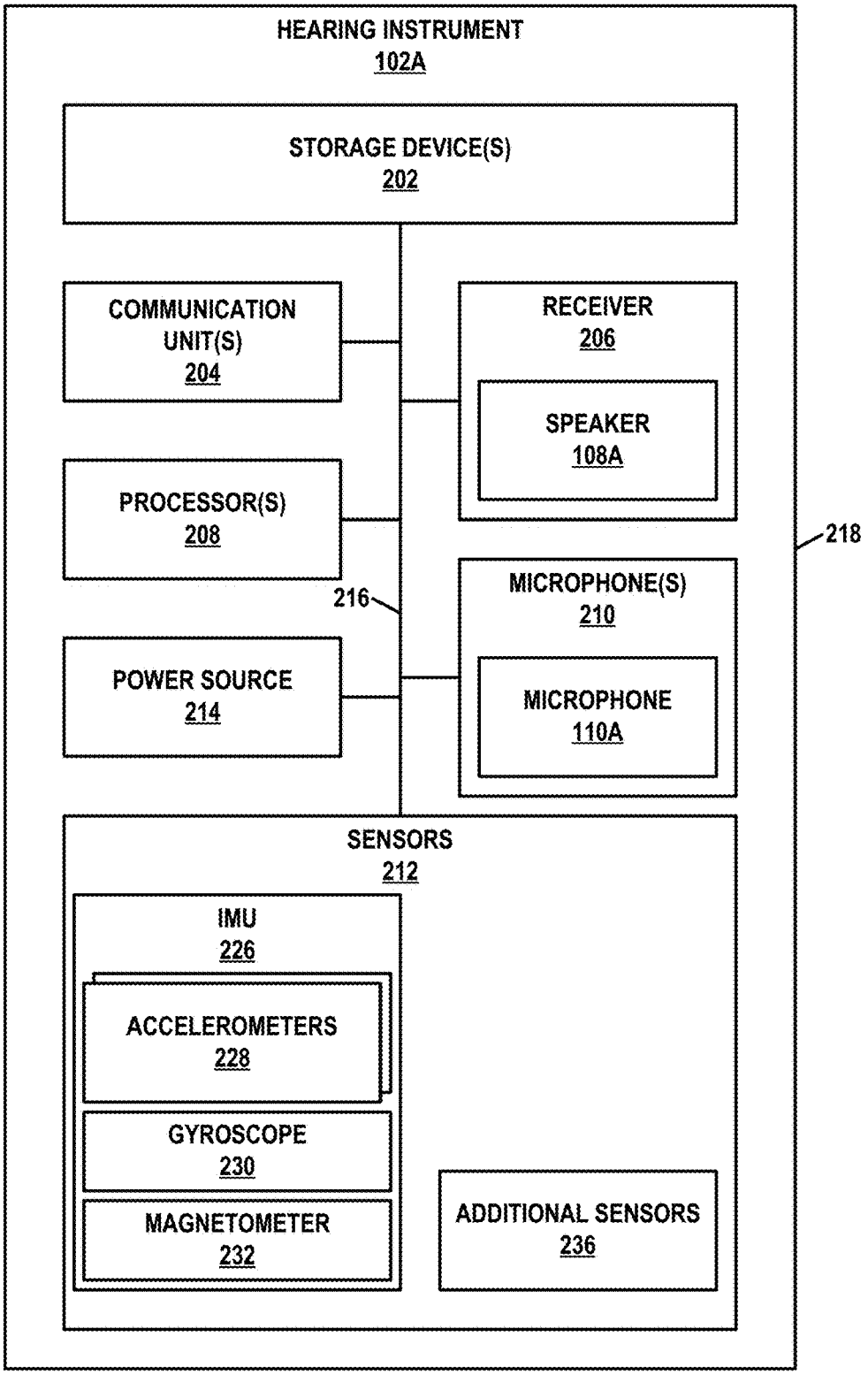
FIG. 2 is a block diagram illustrating example components of a hearing instrument, in accordance with one or more aspects of this disclosure.
Figure 3:
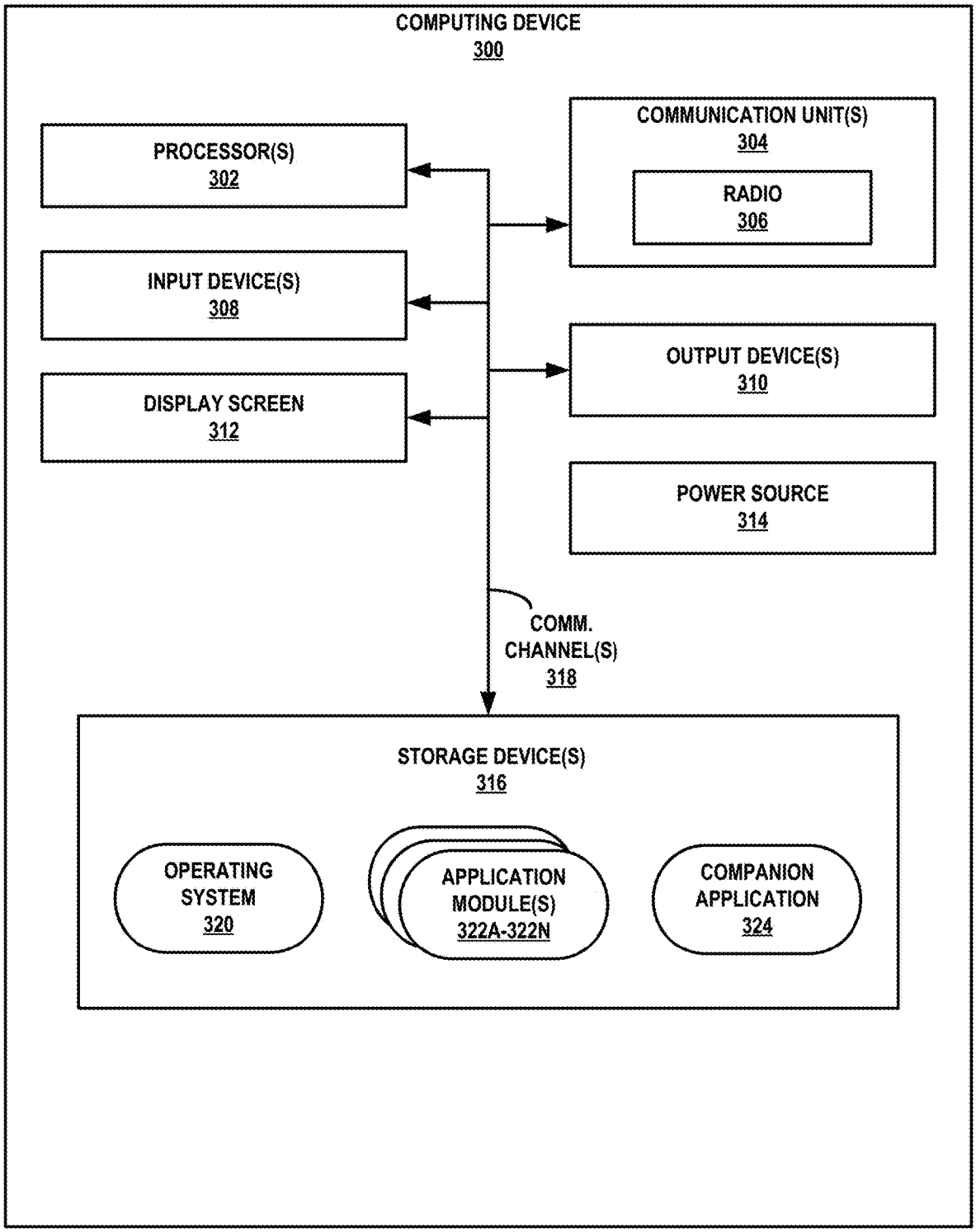
FIG. 3 is a block diagram illustrating example components of a computing device, in accordance with one or more aspects of this disclosure.

It will be appreciated that hearing instruments 102 and computing system 106 may include components in addition to those shown in the example of FIG. 1, e.g., as shown in the examples of FIG. 2 and FIG. 3. For instance, each of hearing instruments 102 may include one or more additional microphones configured to detect sound in an environment of user 104. The additional microphones may include omnidirectional microphones, directional microphones, or other types of microphones.

Speakers 108 may be located on hearing instruments 102 so that sound generated by speakers 108 is directed medially through respective ear canals of user 104. For instance, speakers 108 may be located at medial tips of hearing instruments 102. The medial tips of hearing instruments 102 are designed to be the most medial parts of hearing instruments 102. Microphones 110 may be located on hearing instruments 102 so that microphones 110 may detect sound within the ear canals of user 104.

In the example of FIG. 1, an in-ear assembly 116A of hearing instrument 102A contains speaker 108A and microphone 110A. Similarly, an in-ear assembly 116B of hearing instrument 102B contains speaker 108B and microphone 110B. This disclosure may refer to in-ear assembly 116A and in-ear assembly 116B collectively as "in-ear assemblies 116." The following discussion focuses on in-ear assembly 116A but may be equally applicable to in-ear assembly 116B.

In some examples, in-ear assembly 116A also includes one or more, or all of, processors 112A of hearing instrument 102A. Similarly, an in-ear assembly of hearing instrument 102B may include one or more, or all of, processors 112B of hearing instrument 102B. In some examples, in-ear assembly 116A includes all components of hearing instrument 102A. Similarly, in some examples, in-ear assembly 116B includes all components of hearing instrument 102B. In other examples, components of hearing instrument 102A may be distributed between in-ear assembly 116A and another assembly of hearing instrument 102A. For instance, in examples where hearing instrument 102A is a RIC device, in-ear assembly 116A may include speaker 108A and microphone 110A and in-ear assembly 116A may be connected to a behind-the-ear assembly of hearing instrument 102A via a cable. Similarly, in some examples, components of hearing instrument 102B may be distributed between in-ear assembly 116B and another assembly of hearing instrument 102B. In examples where hearing instrument 102A is an ITE, ITC, CIC, or IIC device, in-ear assembly 116A may include all primary components of hearing instrument 102A. In examples where hearing instrument 102B is an ITE, ITC, CIC, or IIC device, in-ear assembly 116B may include all primary components of hearing instrument 102B.

In some examples where hearing instrument 102A is a BTE device, in-ear assembly 116A may be a temporary-use structure designed to familiarize user 104 with how to insert a sound tube into an ear canal of user 104. In other words, in-ear assembly 116A may help user 104 get a feel for how far to insert a tip of the sound tube of the BTE device into the ear canal of user 104. Similarly, in some examples where hearing instrument 102B is a BTE device, in-ear assembly 116B may be a temporary-use structure designed to familiarize user 104 with how to insert a sound tube into an ear canal of user 104. In some such examples, speaker 108A (or speaker 108B) is not located in in-ear assembly 116A (or in-ear assembly 116B). Rather, microphone 110A (or microphone 110B) may be in a removable structure that has a shape, size, and feel similar to the tip of a sound tube of a BTE device.

Separate fitting processes may be performed to determine whether user 104 has correctly inserted in-ear assemblies 116 of hearing instruments 102 into the user's ear canals. The fitting process may be the same for each of hearing instruments 102. Accordingly, the following discussion regarding the fitting process for hearing instrument 102A may apply equally with respect to hearing instrument 102B.

During the fitting process for hearing instrument 102A, user 104 attempts to insert in-ear assembly 116A of hearing instrument 102A into an ear canal of user 104. Subsequently, speaker 108A generates a sound that includes a range of frequencies. The sound is reflected off surfaces within the ear canal, including the user's tympanic membrane (i.e., ear drum).

In different examples, speaker 108A may generate sound that includes different ranges of frequencies. For instance, in some examples, the range of frequencies is 2,000 to 20,000 Hz. In some examples, the range of frequencies is 2,000 to 16,000 Hz. In other examples, the range of frequencies has different low and high boundaries.

Microphone 110A measures an acoustic response to the sound generated by speaker 108A. The acoustic response to the sound includes portions of the sound reflected by the user's tympanic membrane. As described in greater detail elsewhere in this disclosure, processing system 114 may classify, based on the acoustic response to the sound, a depth of insertion of in-ear assembly 116A of hearing instrument 102A into the ear canal of user 104. For example, processing system 114 may classify the depth of insertion of in-ear assembly 116A of hearing instrument 102A into the ear canal of user 104 as being under-inserted, properly inserted, or over-inserted into the ear canal of user 104. In some examples, in-ear assembly 116A of hearing instrument 102A may be properly inserted when in-ear assembly 116A is entirely inside an ear canal of user 104 (or, minimally, a lateral end of in-ear assembly 116A is flush with an entrance to the ear canal of user 104).

Processing system 114 may generate an indication based on the depth of insertion of in-ear assembly 116A of hearing instrument 102A into the ear canal of user 104. For example, processing system 114 may cause speaker 108A to generate an audible indication indicating whether in-ear assembly 116A of hearing instrument 102A is under-inserted, properly inserted, or over-inserted into the ear canal of user 104. In another example, processing system 114 may cause a notification (e.g., on a smartphone, email message, etc.) to appear indicating the depth of insertion of in-ear assembly 116A of hearing instrument 102A.

FIG. 2 is a block diagram illustrating example components of hearing instrument 102A, in accordance with one or more aspects of this disclosure. Hearing instrument 102B may include the same or similar components of hearing instrument 102A shown in the example of FIG. 2. In the example of FIG. 2, hearing instrument 102A comprises one or more storage devices 202, one or more communication units 204, a receiver 206, one or more processors 208, one or more microphones 210, a set of sensors 212, a power source 214, and one or more communication channels 216. Communication channels 216 provide communication between storage devices 202, communication unit(s) 204, receiver 206, processor(s) 208, microphone(s) 210, and sensors 212. Components 202, 204, 206, 208, 210, and 212 may draw electrical power from power source 214.

In the example of FIG. 2, each of components 202, 204, 206, 208, 210, 212, 214, and 216 are contained within a single housing 218. Thus, in such examples, each of components 202, 204, 206, 208, 210, 212, 214, and 216 may be within in-ear assembly 116A of hearing instrument 102A. However, in other examples of this disclosure, components 202, 204, 206, 208, 210, 212, 214, and 216 may be distributed among two or more housings. For instance, in an example where hearing instrument 102A is a RIC device, receiver 206, one or more of microphones 210, and one or more of sensors 212 may be included in an in-ear housing separate from a behind-the-ear housing that contains the remaining components of hearing instrument 102A. In such examples, a RIC cable may connect the two housings.

Furthermore, in the example of FIG. 2, sensors 212 include an inertial measurement unit (IMU) 226 that is configured to generate data regarding the motion of hearing instrument 102A. IMU 226 may include a set of sensors. For instance, in the example of FIG. 2, IMU 226 includes one or more accelerometers 228, a gyroscope 230, a magnetometer 232, combinations thereof, and/or other sensors for determining the motion of hearing instrument 102A. Furthermore, in the example of FIG. 2, hearing instrument 102A may include one or more additional sensors 236. Additional sensors 236 may include a photoplethysmography (PPG) sensor, blood oximetry sensors, blood pressure sensors, electrocardiograph (EKG) sensors, body temperature sensors, electroencephalography (EEG) sensors, environmental temperature sensors, environmental pressure sensors, environmental humidity sensors, skin galvanic response sensors, and/or other types of sensors. In other examples, hearing instrument 102A and sensors 212 may include more, fewer, or different components.

Storage device(s) 202 may store data. Storage device(s) 202 may comprise volatile memory and may therefore not retain stored contents if powered off. Examples of volatile memories may include random access memories (RAM), dynamic random access memories (DRAM), static random access memories (SRAM), and other forms of volatile memories known in the art. Storage device(s) 202 may further be configured for long-term storage of information as non-volatile memory space and retain information after power on/off cycles. Examples of non-volatile memory configurations may include flash memories, or forms of electrically programmable memories (EPROM) or electrically erasable and programmable (EEPROM) memories.

Communication unit(s) 204 may enable hearing instrument 102A to send data to and receive data from one or more other devices, such as a device of computing system 106 (FIG. 1), another hearing instrument (e.g., hearing instrument 102B), an accessory device, a mobile device, or another types of device. Communication unit(s) 204 may enable hearing instrument 102A to use wireless or non-wireless communication technologies. For instance, communication unit(s) 204 enable hearing instrument 102A to communicate using one or more of various types of wireless technology, such as a BLUETOOTH™ technology, 3G, 4G, 4G LTE, 5G, ZigBee, WI-FI™, Near-Field Magnetic Induction (NFMI), ultrasonic communication, infrared (IR) communication, or another wireless communication technology. In some examples, communication unit(s) 204 may enable hearing instrument 102A to communicate using a cable-based technology, such as a Universal Serial Bus (USB) technology.

Receiver 206 comprises one or more speakers for generating audible sound. Microphone(s) 210 detect incoming sound and generate one or more electrical signals (e.g., an analog or digital electrical signal) representing the incoming sound.

Processor(s) 208 may be processing circuits configured to perform various activities. For example, processor(s) 208 may process signals generated by microphone(s) 210 to enhance, amplify, or cancel-out particular channels within the incoming sound. Processor(s) 208 may then cause receiver 206 to generate sound based on the processed signals. In some examples, processor(s) 208 include one or more digital signal processors (DSPs). In some examples, processor(s) 208 may cause communication unit(s) 204 to transmit one or more of various types of data. For example, processor(s) 208 may cause communication unit(s) 204 to transmit data to computing system 106. Furthermore, communication unit(s) 204 may receive audio data from computing system 106 and processor(s) 208 may cause receiver 206 to output sound based on the audio data.

In the example of FIG. 2, receiver 206 includes speaker 108A. Speaker 108A may generate a sound that includes a range of frequencies. Speaker 108A may be a single speaker or one of a plurality of speakers in receiver 206. For instance, receiver 206 may also include "woofers" or "tweeters" that provide additional frequency range. In some examples, speaker 108A may be implemented as a plurality of speakers.

Furthermore, in the example of FIG. 2, microphones 210 include a microphone 110A. Microphone 110A may measure an acoustic response to the sound generated by speaker 108A.

In some examples, microphones 210 include multiple microphones. Thus, microphone 110A may be a first microphone and microphones 210 may also include a second, third, etc. microphone. In some examples, microphones 210 include microphones configured to measure sound in an auditory environment of user 104. In some examples, one or more of microphones 210 in addition to microphone 110A may measure the acoustic response to the sound generated by speaker 108A. In some examples, processing system 114 may subtract the acoustic response generated by the first microphone from the acoustic response generated by the second microphone in order to help identify a notch frequency. The notch frequency is a frequency in the range of frequencies having a level that is attenuated in the acoustic response relative to levels in the acoustic response of frequencies surrounding the frequency. Use of the notch frequency in classifying the depth of insertion of an in-ear assembly of a hearing instrument into an ear canal of user 104 is described in greater detail elsewhere in this disclosure.

Furthermore, in some examples, housing 218 may define two ports for microphone 110A. The two ports may be spaced at least 4 millimeters apart. Measuring sounds arriving through the two separate ports may improve the ability of processing system 114 to determine the notch frequency. Measurements of the acoustic response that are made through different ports at different positions within the ear canal will have different notch frequencies. Therefore, when processing system 114 subtracts one measurement of the acoustic response from the other measurement of the acoustic response, there may be large differences in the levels at these notch frequencies, making the notch frequencies easy to identify. If two measurements are made very close to each other in the ear canal, there will be overlap in their notch locations (frequencies), and when subtracting one measurement from the other, the level differences will be less, and therefore it will be less obvious where the notch is occurring. For example, if processing system 114 were to subtract a measurement that is taken 2 mm from the eardrum from a measurement that is taken from 16 mm from the eardrum, there would be a more pronounced difference between these curves than if one subtracted the measurement at 14 mm from the eardrum from the one at 16 mm from the eardrum. Thus, in some examples, a shell of in-ear assembly 116A may define a first port and a second port. Processing system 114 may obtain the acoustic response to the sound as measured by a microphone through the first port and obtain the acoustic response to the sound as measured by the microphone through the second port. In this example, the processing system 114 may determine the notch frequency based on the acoustic response as measured by the microphone through the first port or the acoustic response as measured by the microphone through the second port or the difference between the two acoustic responses.

In some examples, microphone 110A is detachable from hearing instrument 102A. Thus, after the fitting process is complete and user 104 is familiar with how in-ear assembly 116A of hearing instrument 102A should be inserted into the user's ear canal, microphone 110A may be detached from hearing instrument 102A. Removing microphone 110A may decrease the size of in-ear assembly 116A of hearing instrument 102A and may increase the comfort of user 104.

In some examples, an earbud is positioned over the tips of speaker 108A and microphone 110A. In the context of this disclosure, an earbud is a flexible, rigid, or semi-rigid component that is configured to fit within an ear canal of a user. The earbud may protect speaker 108A and microphone 110A from earwax. Additionally, the earbud may help to hold in-ear assembly 116A in place. The earbud may comprise a biocompatible, flexible material, such as a silicone material, that fits snugly into the ear canal of user 104.

As noted above, hearing instrument 102A may include a set of one or more sensors 212. In some examples, the fitting operation of this disclosure may help with the placement of sensors 212 (e.g., a heartrate sensor and/or a temperature sensor). That is, if processing system 114 is able to determine, based on the acoustic response to the sound generated by speaker 108A, a depth of insertion of an in-ear assembly of hearing instrument 102A, processing system 114 may, in doing so, determine locations of sensors 212. In this case, processing system 114 may be preconfigured with data regarding positional relationships (e.g., the distances) between the additional sensors and in-ear assembly 116A. In this way, processing system 114 may classify the depth of insertion of the sensors of the hearing instrument into the ear canal based on whether the depth of insertion of the in-ear assembly of the hearing instrument into the ear canal is appropriate for one or more sensors included in the in-ear assembly of the hearing instrument.

If stock components (e.g., one or more of sensors 212) are fixed in place and are the same for each individual, then this information may be pre-programmed into hearing instruments by a manufacturer or other party. For instance, processing system 114 may be configured with data indicating that a temperature sensor is "x" mm from an end of in-ear assembly 116A of hearing instrument 102A. If the components (e.g., sensors) are custom, distances between components may be measured (e.g., by the shell modelers who design the placement of the hearing aid components in the earmold) and programmed into hearing instrument 102A. In some examples, the components themselves, once assembled into an earmold, communicate with each other to determine their relative positions; this may be done using hard wired or wireless signals.

FIG. 3 is a block diagram illustrating example components of computing device 300, in accordance with one or more aspects of this disclosure. FIG. 3 illustrates only one particular example of computing device 300, and many other example configurations of computing device 300 exist. Computing device 300 may be a computing device in computing system 106 (FIG. 1).

As shown in the example of FIG. 3, computing device 300 includes one or more processors 302, one or more communication units 304, one or more input devices 308, one or more output device(s) 310, a display screen 312, a power source 314, one or more storage device(s) 316, and one or more communication channels 318. Computing device 300 may include other components. For example, computing device 300 may include physical buttons, microphones, speakers, communication ports, and so on. Communication channel(s) 318 may interconnect each of components 302, 304, 308, 310, 312, and 316 for inter-component communications (physically, communicatively, and/or operatively). In some examples, communication channel(s) 318 may include a system bus, a network connection, an inter-process communication data structure, or any other method for communicating data. Power source 314 may provide electrical energy to components 302, 304, 308, 310, 312 and 316.

Storage device(s) 316 may store information required for use during operation of computing device 300. In some examples, storage device(s) 316 have the primary purpose of being a short-term and not a long-term computer-readable storage medium. Storage device(s) 316 may be volatile memory and may therefore not retain stored contents if powered off. Storage device(s) 316 may be configured for long-term storage of information as non-volatile memory space and retain information after power on/off cycles. In some examples, processor(s) 302 on computing device 300 read and may execute instructions stored by storage device(s) 316.

Computing device 300 may include one or more input devices 308 that computing device 300 uses to receive user input. Examples of user input include tactile, audio, and video user input. Input device(s) 308 may include presence-sensitive screens, touch-sensitive screens, mice, keyboards, voice responsive systems, microphones or other types of devices for detecting input from a human or machine.

Communication unit(s) 304 may enable computing device 300 to send data to and receive data from one or more other computing devices (e.g., via a communications network, such as a local area network or the Internet). For instance, communication unit(s) 304 may be configured to receive data sent by hearing instrument(s) 102, receive data generated by user 104 of hearing instrument(s) 102, receive and send request data, receive and send messages, and so on. In some examples, communication unit(s) 304 may include wireless transmitters and receivers that enable computing device 300 to communicate wirelessly with the other computing devices. For instance, in the example of FIG. 3, communication unit(s) 304 include a radio 306 that enables computing device 300 to communicate wirelessly with other computing devices, such as hearing instruments 102 (FIG. 1). Examples of communication unit(s) 304 may include network interface cards, Ethernet cards, optical transceivers, radio frequency transceivers, or other types of devices that are able to send and receive information. Other examples of such communication units may include BLUETOOTH™, 3G, 4G, 5G, and WI-FI™ radios, Universal Serial Bus (USB) interfaces, etc. Computing device 300 may use communication unit(s) 304 to communicate with one or more hearing instruments (e.g., hearing instrument 102 (FIG. 1, FIG. 2)). Additionally, computing device 300 may use communication unit(s) 304 to communicate with one or more other remote devices.

Output device(s) 310 may generate output. Examples of output include tactile, audio, and video output. Output device(s) 310 may include presence-sensitive screens, sound cards, video graphics adapter cards, speakers, liquid crystal displays (LCD), or other types of devices for generating output. Output device(s) 310 may include display screen 312.

Processor(s) 302 may read instructions from storage device(s) 316 and may execute instructions stored by storage device(s) 316. Execution of the instructions by processor(s) 302 may configure or cause computing device 300 to provide at least some of the functionality ascribed in this disclosure to computing device 300. As shown in the example of FIG. 3, storage device(s) 316 include computer-readable instructions associated with operating system 320, application modules 322A-322N (collectively, "application modules 322"), and a companion application 324.

Execution of instructions associated with operating system 320 may cause computing device 300 to perform various functions to manage hardware resources of computing device 300 and to provide various common services for other computer programs. Execution of instructions associated with application modules 322 may cause computing device 300 to provide one or more of various applications (e.g., "apps," operating system applications, etc.). Application modules 322 may provide applications, such as text messaging (e.g., SMS) applications, instant messaging applications, email applications, social media applications, text composition applications, and so on.

Execution of instructions associated with companion application 324 by processor(s) 302 may cause computing device 300 to perform one or more of various functions. For example, execution of instructions associated with companion application 324 may cause computing device 300 to configure communication unit(s) 304 to receive data from hearing instruments 102 and use the received data to present data to a user, such as user 104 or a third-party user. In some examples, companion application 324 is an instance of a web application or server application. In some examples, such as examples where computing device 300 is a mobile device or other type of computing device, companion application 324 may be a native application.

In some examples, companion application 324 may classify a depth of insertion of the in-ear assembly of a hearing instrument based on the acoustic response to the sound generated by a speaker of the hearing instrument. Furthermore, in some examples, companion application 324 may generate an indication based on the depth of insertion of the in-ear assembly of the hearing instrument into the ear canal of user 104. For example, companion application 324 may output, for display on display screen 312, a message that includes the indication. In some examples, companion application 324 may send data to a hearing instrument (e.g., one of hearing instruments 102) that causes the hearing instrument to output an audible and/or tactile indication of the depth of insertion of the in-ear assembly of the hearing instrument into the ear canal of the user. In some examples, such as examples where computing device 300 is a server device, companion application 324 may send a notification (e.g., a text message, email message, push notification message, etc.) to a device (e.g., a mobile phone, smart watch, remote control, tablet computer, personal computer, etc.) associated with user 104 to notify user 104 of the insertion level of the in-ear assembly of the hearing instrument.

Figure 4:
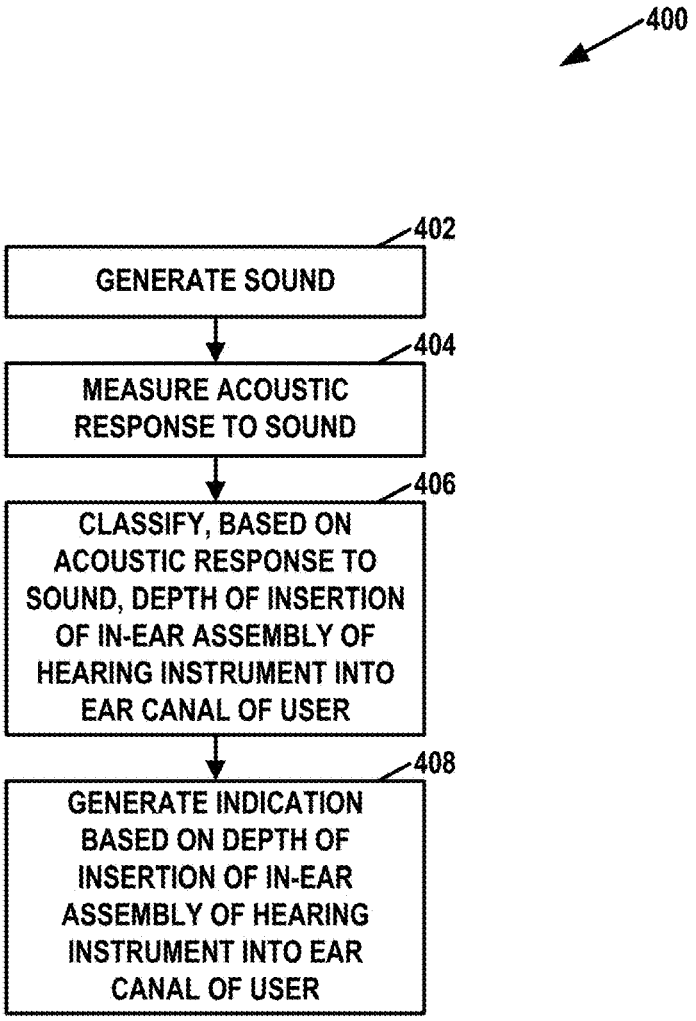
FIG. 4 is a flowchart illustrating an example fitting operation in accordance with one or more aspects of this disclosure.

FIG. 4 is a flowchart illustrating an example fitting operation 400, in accordance with one or more aspects of this disclosure. Other examples of this disclosure may include more, fewer, or different actions. Although this disclosure describes FIG. 4 with reference to hearing instrument 102A, operation 400 may be performed in the same way with respect to hearing instrument 102B, or another hearing instrument.

The fitting operation 400 of FIG. 4 may begin in response to one or more different types of events. For example, user 104 may initiate fitting operation 400. In other words, processing system 114 may initiate fitting operation 400 in response to input from user 104. For instance, user 104 may initiate fitting operation 400 using a voice command or by providing appropriate input to a device (e.g., a smartphone, accessory device, or other type of device). In some examples, processing system 114 automatically initiates fitting operation 400. For instance, in some examples, processing system 114 may automatically initiate fitting operation 400 on a periodic basis. Furthermore, in some examples, processing system 114 may use a determination of a depth of insertion of in-ear assembly 116A of hearing instrument 102A for a fixed or variable amount of time before automatically initiating fitting operation 400 again. In some examples, fitting operation 400 may be performed a specific number of times before processing system 114 determines that results of fitting operation 400 are acceptable. For instance, after fitting operation 400 has been performed a specific number of times with user 104 achieving a proper depth of insertion of in-ear assembly 116A of hearing instrument 102A, processing system 114 may stop automatically initiating fitting operation 400. In other words, after several correct placements of hearing instrument 102A, processing system 114 may stop automatically initiating fitting operation 400 or may phase out initiating fitting operation 400 over time. Thus, in some examples, processing system 114 may determine, based on a history of attempts by user 104 to insert in-ear assembly 116A of hearing instrument 102A into the ear canal of user 104, whether to initiate a fitting process that comprises generating the sound, measuring the acoustic response, and classifying the depth of insertion of in-ear assembly 116A of hearing instrument 102A into the ear canal of user 104.

In some examples where hearing instruments 102 include rechargeable power sources (e.g., when power source 214 (FIG. 2) is rechargeable), processing system 114 may automatically initiate fitting operation 400 in response to detecting that one or more of hearing instruments 102 have been removed from a charger, such as a charging case. In some examples, processing system 114 may detect that one or more of hearing instruments 102 have been removed from the charger by detecting an interruption of an electrical current between the charger and one or more of hearing instruments 102. Furthermore, in some examples, processing system 114 may automatically initiate fitting operation 400 in response to determining that one or more of hearing instruments 102 are in contact with the ears of user 104. In this example, processing system 114 may determine that one or more of hearing instruments 102 are in contact with the ears of user 104 based on signals from one or more capacitive switches or other sensors of hearing instruments 102. Thus, in this way, processing system 114 may determine whether an initiation event has occurred. Example types of initiation events may include one or more of removal of one or more of hearing instruments 102 from a charger, contact of the in-ear assembly of a hearing instrument with skin, detecting that the hearing instrument is on an ear of a user (e.g., using positional sensors, using wireless communications, etc.), input from user 104. Processing system 114 may initiate a fitting process in response to the initiation event, wherein the fitting process includes generating the sound, measuring the acoustic response, and classifying the depth of insertion of the in-ear assembly of the hearing instrument into the ear canal of the user.

In some examples, processing system 114 may automatically initiate fitting operation 400 in response to determining that one or more of hearing instruments 102 are generally positioned in the ears of user 104. For example, processing system 114 may automatically initiate fitting operation 400 in response to determining, based on signals from IMUs (e.g., IMU 226) of hearing instruments 102, that hearing instruments 102 are likely positioned on the head of user 104. For instance, in this example, if the IMU signals indicate synchronized motion in one or more patterns consistent with movements of a human head (e.g., nodding, rotating, tilting, head movements associated with walking, etc.), processing system 114 may determine that hearing instruments 102 are likely positioned on the head of user 104.

In some examples, processing system 114 may automatically initiate fitting operation 400 in response to determining, based on wireless communication signals exchanged between hearing instruments 102, that hearing instruments 102 are likely positioned on the head of user 104. For instance, in this example, processing system 114 may determine that hearing instruments 102 are likely positioned on the head of user 104 when hearing instruments 102 are able to wirelessly communicate with each other (and, in some examples, an amount of signal attenuation is consistent with communication between hearing instruments positioned on opposite ears of a human head). In some examples, processing system 114 may determine that hearing instruments 102 are generally positioned on the head of user 104 based on a combination of factors, such as IMU signals indicating synchronized motion in one or more patterns consistent with movements of the human head and hearing instruments 102 being able to wirelessly communicate with each other. In some examples, processing system 114 may determine that hearing instruments 102 are generally position on the head of user 104 based on a specific time delay for wireless communication between hearing instruments 102.

In the example of FIG. 4, speaker 108A generates a sound (402). The sound includes a range of frequencies. In some instances, user 104 may be able to hear the sound. However, this typically is not a concern for user 104 because the sound is generated as part of the fitting operation and not during typical use of hearing instrument 102A.

Microphone 110A measures an acoustic response to the sound (404). That is, microphone 110A may generate an electrical signal representing soundwaves that reflect back to in-ear assembly 116A of hearing instrument 102A when speaker 108A generates the sound. In some examples, microphone 110A, or another component, converts this electrical signal from an analog form to a digital form.

Furthermore, in the example of FIG. 4, processing system 114 may classify, based on the acoustic response to the sound, a depth of insertion of in-ear assembly 116A of hearing instrument 102A into the ear canal of user 104 (406). In some examples, one or more processors 112A classify the depth of insertion of in-ear assembly 116A of hearing instrument 102A. In some examples, one or more processors 112C classify the depth of insertion of in-ear assembly 116A of hearing instrument 102A. In some examples, one or more processors of another hearing instrument (e.g., one or more processors 112B of hearing instrument 102B) classify the depth of insertion. In some examples, a combination of two or more of processors 112A, 112B, and 112C classify the depth of insertion of in-ear assembly 116A of hearing instrument 102A.

Processing system 114 may classify the depth of insertion in various ways. For example, processing system 114 may determine a notch frequency based on the acoustic response. The notch frequency is a frequency in the range of frequencies that has a level that is attenuated in the acoustic response relative to levels in the acoustic response of the frequencies surrounding the frequency. The notch frequency occurs because sound within the sound at the notch frequency is at least partially canceled by sound reflecting from the tympanic membrane of user 104.

Furthermore, in this example, processing system 114 may estimate, based on the notch frequency, a distance metric associated with a distance from in-ear assembly 116A to the tympanic membrane of user 104 of hearing instrument 102A. In some examples, the distance metric is the distance from in-ear assembly 116A to the tympanic membrane of user 104. In some examples, the distance metric is a value having a mathematic relationship to the distance from in-ear assembly 116A to the tympanic membrane of user 104. For instance, processing system 114 may determine a distance metric associated with one-quarter wavelength (i.e., $\lambda/4$, where $\lambda$ is the wavelength) of the notch frequency. For example, processing system 114 may divide the velocity of sound (e.g., 343 meters/second in air at 20° C.) by the notch frequency, and then divide the result by 4. For example, if the notch frequency is at 4000 Hz, then 343/4000=0.08575; 0.08575/4=0.0214375 meters 21.4 mm.

As noted above, hearing instrument 102A may, in some examples, include two or more microphones. Thus, microphone 110A may be a first microphone 110A and hearing instrument 102B may include at least a second, additional microphone. Processing system 114 may determine the notch frequency based on the acoustic response to the sound as measured by the two or more microphones (e.g., the first and second microphones). For example, processing system 114 may determine the notch frequency based on the acoustic response as measured by the first microphone minus the acoustic response as measured by the second microphone.

In some examples, in-ear assemblies 116 of hearing instruments 102 each include one microphone (e.g., microphone 110A, 110B) facing into the ear canal. In such examples, the measured response would be analyzed to determine a frequency at which the notch is occurring (e.g. by determining where the output is the lowest within some (expected) range of frequencies). In some such examples, each of microphones 110 has one port (i.e., an entrance for sound). In other examples, each of microphone 110 has two ports (entrances for sound) that are located at least a specific distance (e.g., ≥4 mm) apart. In some examples, processing system 114 may differentiate between the sounds detected from the different ports of the same microphone based on an amount of delay in the acoustic response reaching the different ports. In such examples, sound arriving at the microphone through one port is effectively subtracted (e.g., due to opposing pressure on opposite sides of a diaphragm of the microphone) from the sound arriving at the microphone through the other port. Processing system 114 may then use the resulting signal to determine the notch frequency.

Furthermore, in some examples, the in-ear portions 116 of hearing instruments 102 may each have two separate microphones facing into the ear canal that are at least a specific distance (e.g., ≥4 mm) apart. Having two ports (or two microphones) may have the advantages previously listed (e.g., that subtracting these two measurements from each other makes it easier to identify the notch frequency and therefore estimate the distance to the eardrum). Both implementations—one microphone with two ports or two separate microphones are commonly used with directional microphones.

After estimating the distance metric, processing system 114 may classify the depth of insertion of in-ear assembly 116A of hearing instrument 102A into the ear canal of user 104 based on the distance metric. For instance, processing system 114 may classify, based on the distance metric and a range of ear canal lengths for the user, the depth of insertion of in-ear assembly 116A of hearing instrument 102A into the ear canal of user 104. For example, processing system 114 may classify the depth of insertion of in-ear assembly 116A of hearing instrument 102A into the ear canal of user 104 as being under-inserted, properly inserted, or over-inserted into the ear canal of user 104.

In some examples, because ears differ in size and impedance across populations, processing system 114 may use different normative data for different types of people (e.g., children vs. adults, or those with conductive hearing loss vs. those without conductive hearing loss). Accordingly, processing system 114 may estimate the range of ear canal lengths for user 104 based on demographic or personal data regarding user 104. For example, processing system 114 may estimate the range of ear canal lengths for 104 based on information such as the sex, race, age, height, and/or other demographic or personal information about user 104. In some examples, processing system 114 may receive the demographic and/or personal information via a user interface, such as a graphical user interface or a voice interface. Processing system 114 may use the received demographic and/or personal information to look up estimated ranges of ear canal lengths from a local or remote database.

In some examples, processing system 114 may determine some or all of the demographic and/or personal data based on a sound of a voice of user 104. For example, processing system 114 may obtain an audio signal of the voice of user 104. In some examples, processing system 114 obtains the audio signal from one or more of microphones 110. Processing system 114 may then use the audio signal to determine the demographic and/or personal data about user 104. For example, processing system 114 may determine a gender of user 104, an age group of user 104, and or other data about user 104 based on the audio signal. For instance, processing system 114 may determine the gender of user 104 and/or age group of user 104 based on a fundamental frequency of the voice of user 104. That is, the voices of men typically have lower fundamental frequencies than women. Similarly, the voices of adults typically have lower fundamental frequencies than children.

As noted above, processing system 114 may classify the depth of insertion of the in-ear assembly 116A of hearing instrument 102A into the ear canal of user 104. In some examples, processing system 114 may determine whether the depth of insertion of in-ear assembly 116A of hearing instrument 102A into the ear canal of user 104 is in a first class or a second class. In such examples, the first class may correspond to under-insertion of the in-ear assembly 116A of hearing instrument 102A into the ear canal of the user and the second class may correspond to adequate insertion of in-ear assembly 116A of hearing instrument 102A into the ear canal of user 104. In some examples, processing system 114 may determine whether the depth of insertion of in-ear assembly 116A of hearing instrument 102A into the ear canal of user 104 is in a first class, a second class, or a third class. In such examples, the first class may correspond to under-insertion of the in-ear assembly 116A of hearing instrument 102A into the ear canal of user 104, the second class may correspond to adequate insertion of the in-ear assembly of hearing instrument into the ear canal of user 104, and the third class may correspond to an ambiguous level of insertion of in-ear assembly 116A of hearing instrument 102A into the ear canal of user 104. There may be an ambiguous level of insertion of in-ear assembly 116A of hearing instrument 102 into the ear canal of user 104 when in-ear assembly 116A may be inserted properly for someone with a larger ear canal but not for someone with a smaller ear canal.

It is observed that the acoustic responses to sounds generated by speakers 108 may be different for different ears of the same person. In other words, the acoustic response to a sound generated in the left ear of user 104 may differ from the acoustic response to the same sound generated in the right ear of user 104. For instance, the acoustic response in the left ear to a sound at a frequency of 8000 Hz may be 30 dB and the acoustic response in the right ear to a sound at the frequency of 8000 Hz may be 40 dB. These differences may be attributable to differences in the lengths and shapes of the left and right ear canals of user 104 and to differences in the location and orientation of the speakers 108 and microphones 110 in the user's 104 ears.

In some examples, processing system 114 may determine, based on the acoustic response to the sound, whether in-ear assembly 116A of hearing instrument 102A is inserted into a specific ear of user 104. For instance, if in-ear assembly 116A is configured to be inserted into the left ear of user 104, processing system 114 may determine, based on the acoustic response to the sound, whether in-ear assembly 116 is inserted into the left ear of user 104. Similarly, if in-ear assembly 116A is configured to be inserted into the right ear of user 104, processing system 114 may determine, based on the acoustic response to the sound, whether in-ear assembly 116 is inserted into the right ear of user 104.

Profile information may be stored (e.g., in storage device(s) 202 (FIG. 2) or storage device(s) 316 (FIG. 3)) for an ear (or both ears) of user 104. To determine whether in-ear assembly 116A is inserted into a specific ear of user 104, processing system 114 may cause speaker 108A to generate a sound that includes a range of frequencies. Microphone 110A may measure an acoustic response to the sound. Processing system 114 may then compare the acoustic response to the profile information for the specific ear. For example, processing system 114 may compare levels of the acoustic response at various frequencies with corresponding levels for the frequencies indicated by the profile information. In this example, processing system 114 may derive a difference metric (e.g., mean squared error, sum of absolute differences, etc.) from the comparison. Furthermore, processing system 114 may determine, based on the difference metric, whether in-ear assembly 116A is in the specific ear. For instance, processing system 114 may determine that in-ear assembly 116A is in the specific ear based on the difference metric being less than a threshold. Although described with respect to components of hearing instrument 102A (e.g., speaker 108A, microphone 110A, in-ear assembly 116A, etc.), a similar process may be performed with respect to hearing instrument 102B and components thereof (e.g., speaker 108B, microphone 110A, in-ear assembly 116B, etc.).

In some examples, the profile information may associate labels with specific ears. For instance, the profile information associated with a specific ear may be labeled as the user's left ear and profile information associated with another ear may be labeled as the user's right ear. Processing system 114 may use these labels when providing information to user 104 about hearing instruments 102. For example, processing system 114 may output an indication (e.g., an audible, visual or tactile indication) that user 104 has inserted the hearing instrument configured for use in the left ear of user 104 into the right ear of user 104, or vice versa. In some examples, the profile information and associated labels are generated by processing system 114 during an initial fitting of hearing instruments 102 or at a later time. In some examples, processing system 114 may stop or reduce checking of whether hearing instruments 102 are in specific ears over time (e.g., after a given time or correct number of insertions).

FIG. 5A, FIG. 5B, FIG. 5C, and FIG. 5D are conceptual diagrams illustrating example in-ear assemblies inserted into ear canals of users, in accordance with one or more aspects of this disclosure. In some examples, processing system 114 may determine that the depth of insertion of in-ear assembly 116A of hearing instrument 102A into the ear canal is the first class or the second class depending on whether the distance metric is associated with a distance within a specified range. The specified range may be defined by (1) an upper end of the range of ear canal lengths for the user minus a length of all or part of in-ear assembly 116A of hearing instrument 102A and (2) a lower end of the range of ear canal lengths of the user minus the length of all or part of in-ear assembly 116A of hearing instrument 102A. Thus, the specified range may take into account the size of in-ear assembly 116A, which may contain speaker 108A, microphone 110A, and earbud 500. For instance, the length of all or part of in-ear assembly 116A may be limited to earbud 500; a portion of in-ear assembly 116A that contains speaker 108A, microphone 110A, and earbud 500; or all of in-ear assembly 116A.

Figure 5A:
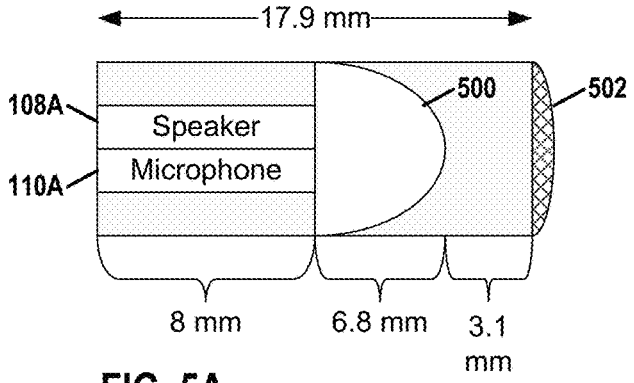
FIG. 5A, FIG. 5B, FIG. 5C, and FIG. 5D are conceptual diagrams illustrating example in-ear assemblies inserted into ear canals of users, in accordance with one or more aspects of this disclosure.
Figure 5B:
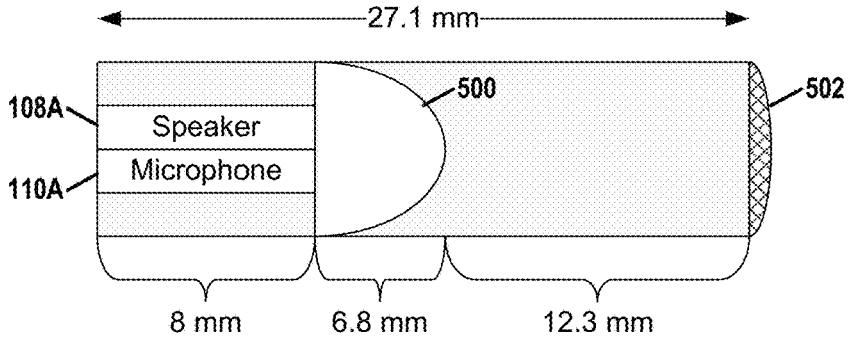

For example, if an average ear canal length for a female is 22.5 millimeters (mm), with a standard deviation (SD) of 2.3 mm, then most females have an ear canal length between 17.9-27.1 mm (mean±2 SD). Assuming that a proper fitting of a hearing instrument 102A involves in-ear assembly 116A being entirely in the ear canal of user 104, and that in-ear assembly 116A is 14.8 mm long, then the proper fitting occurs when in-ear assembly 116A is between 3.1 mm (17.9−14.8=3.1) and 12.3 mm (27.1−14.8=12.3) from the tympanic membrane 502 of user 104 (FIG. 5A). In this example, the specified range is 3.1 mm to 12.3 mm. In the examples of FIGS. 5A-5D, in-ear assembly 116A includes speaker 108A, microphone 110A, and an earbud 500. The shaded areas in FIGS. 5A-5D correspond to the user's ear canal. FIGS. 5A-5D also show a tympanic membrane 502 of user 104. FIG. 5A shows proper insertion when the total length of the user's ear canal is at the short end of the range of typical ear canal lengths for females (i.e., 17.9 mm). FIG. 5B shows proper insertion when the total length of the user's ear canal is at the long end of the range of typical ear canal lengths for females (i.e., 27.1 mm).

FIGS. 5A-5D show tympanic membrane 502 as an arc-shaped structure. In reality, tympanic membrane 502 may be angled relative to the ear canal and may span a length of approximately 6 mm from the superior end of tympanic membrane 502 to a vertex of tympanic membrane, which is more medial than the superior end of tympanic membrane 502. The acoustically estimated distance metric from in-ear assembly 116A to tympanic membrane 502 is typically considered to be (or otherwise associated with) a distance from in-ear assembly 116A to a location between a superior end of tympanic membrane 502 and the umbo of tympanic membrane 502, which is located in the center part of tympanic membrane 502.

Figure 5C:
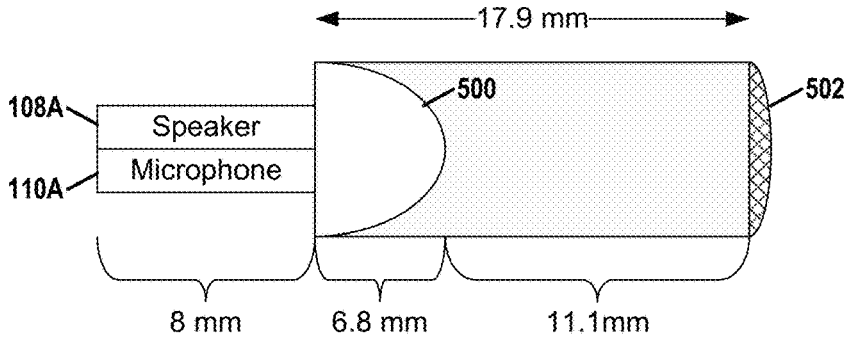
Figure 5D:
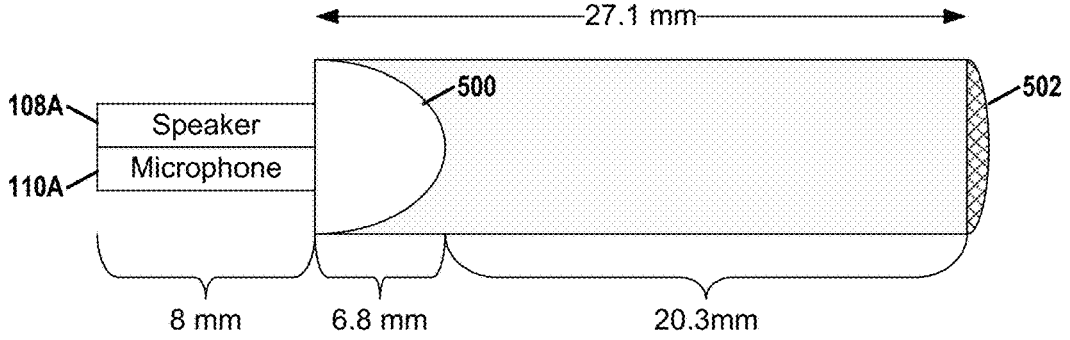

If it is assumed that hearing instrument 102A has a "poor" fitting when user 104 only inserts earbud 500 into the user's ear canal and it is assumed that earbud 500 is 6.8 mm long, then a poor fitting may mean that in-ear assembly 116A is between 11.1 and 20.3 mm from the user's eardrum 502 (17.9−6.8=11.1; and 27.1−6.8=20.3) (FIG. 5C and FIG. 5D). In this example, if the ¼ wavelength of the notch frequency implies that the distance from in-ear assembly 116A to tympanic membrane 502 is less than 11 mm, processing system 114 may determine that in-ear assembly 116A is likely inserted properly (e.g., as shown in FIG. 5A and FIG. 5B). However, if the ¼ wavelength of the notch frequency implies that the distance from in-ear assembly 116A to tympanic membrane 502 is greater than 12.3 mm (e.g., as shown in FIG. 5D), processing system 114 may determine that in-ear assembly 116A is likely not inserted properly.

If the ¼ wavelength of the notch frequency implies that the distance from in-ear assembly 116A to tympanic membrane 502 is between 11 mm and 12.3 mm, the reading may be ambiguous. That is, in-ear assembly 116A could be inserted properly for someone with a larger ear canal but not for someone with a smaller ear canal. In this case, processing system 114 may output an indication instructing user 104 to try inserting in-ear assembly 116A more deeply into the ear canal of user 104 and/or to try a differently sized earbud (e.g., because earbud 500 may be too big and may be preventing user 104 from inserting in-ear assembly 116A deeply enough into the ear canal of user 104. Additionally, processing system 114 may output an indication instructing user 104 to perform fitting operation 400 again. If the distance from in-ear assembly 116A to tympanic membrane 502 is now within the acceptable range, it is likely that in-ear assembly 116A was not inserted deeply enough. However, if the estimated distance from in-ear assembly 116A to tympanic membrane 502 does not change, this may suggest that user 104 just has longer ear canals than average. The measurement of the distance from in-ear assembly 116A to tympanic membrane 502 may be made multiple times over days, weeks, month, years, etc. and the results monitored over time to determine a range of normal placement for user 104.

Different assumptions may be made regarding (1) what normative data (e.g., different sets of norms of ear canal length) to use, (2) the number of standard deviations to use when defining a "normal" range of ear canal lengths, (3) how large in-ear assembly 116A is, and (4) what constitutes a good or a poor fitting in terms of how deeply in-ear assembly 116A is inserted into the person's ear canal. The numbers that were used above (e.g., with respect to FIGS. 5A-5D) are for illustration purposes only. Further, while the examples above (e.g., with respect to FIGS. 5A-5D) are only given for adult female ear canals, comparable calculations could be made for males' ear canals, ear canals of people of different ages, and ear canals of people with known conductive components to their hearing losses.

Figure 6:
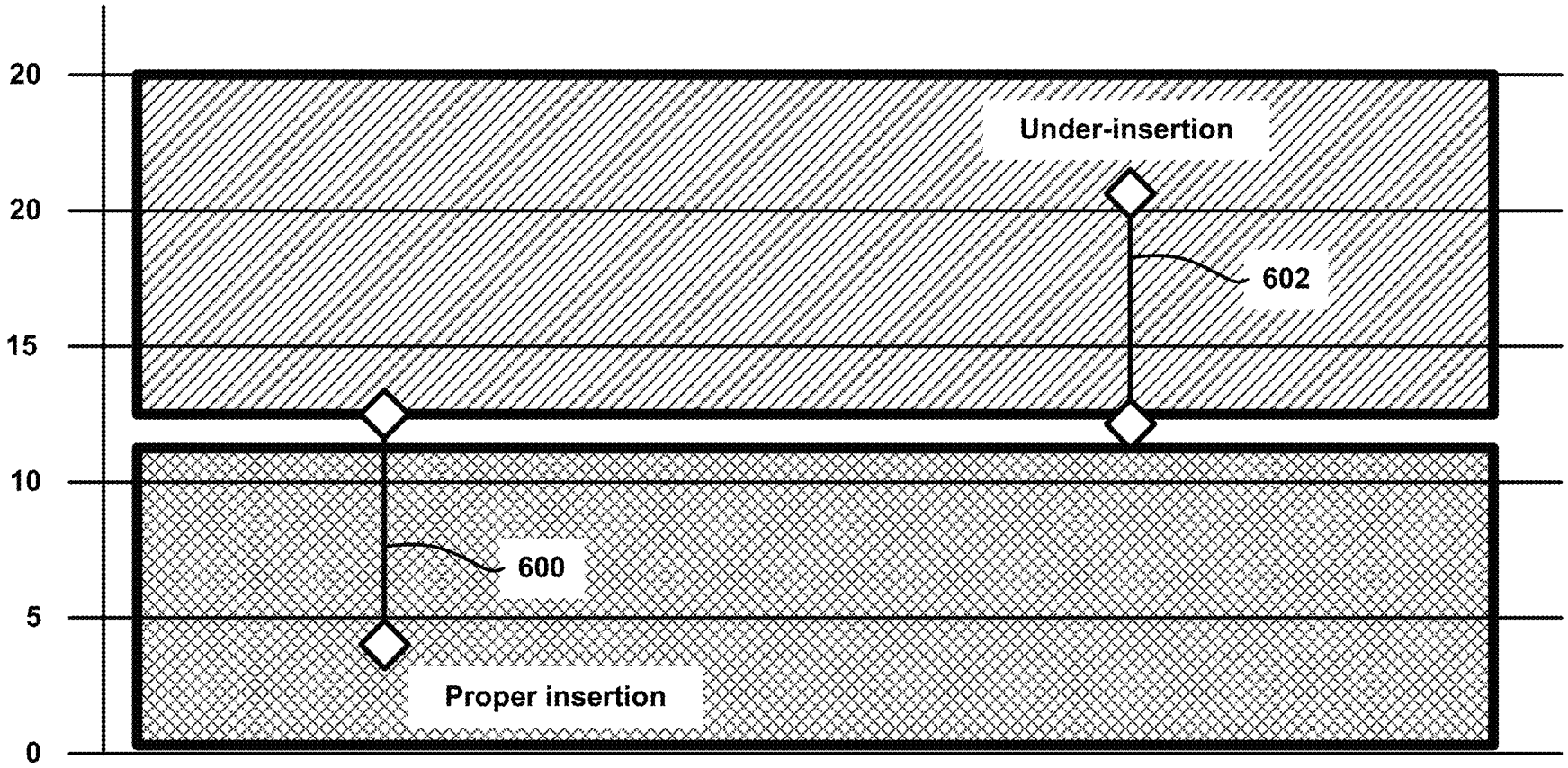
FIG. 6 is a conceptual diagram illustrating example cutoffs for classifying levels of insertion of an in-ear assembly of a hearing instrument into an ear canal of a user, in accordance with one or more aspects of this disclosure.

FIG. 6 is a conceptual diagram illustrating example cutoffs for classifying levels of insertion of an in-ear assembly of hearing instrument 102A into an ear canal of user 104, in accordance with one or more aspects of this disclosure. FIG. 6 is described with reference to hearing instrument 102A but may be equally applicable to hearing instrument 102B. In the example of FIG. 6, the vertical axis corresponds to a distance from in-ear assembly 116A to the tympanic membrane (e.g., tympanic membrane 502 of FIGS. 5A-5D).

In the example of FIG. 6, cutoffs that represent proper, ambiguous, or under-insertion of in-ear assembly 116A are indicated for adult females. The white diamonds represent endpoints of ranges of proper insertion and under-insertion given in the examples of FIGS. 5A-5D, with textured (e.g., single or double diagonal cross-hatching) regions representing cutoffs below and above which a depth of insertion of in-ear assembly 116A is considered to be properly inserted or under-inserted. For instance, vertical bar 600 indicates a range of distances that may be associated with proper insertion of in-ear assembly 116A into the ear canal of user 104. A vertical bar 602 indicates a range of distances that may be associated with under-insertion of in-ear assembly 116A into the ear canal of user 104.

Furthermore, in the example of FIG. 4, processing system 114 may generate an indication based on the depth of insertion of in-ear assembly 116A of hearing instrument 102A into the ear canal of user 104 (408). Processing system 114 may generate the indication in one or more ways. For instance, in some examples, processing system 114 may cause speaker 108A of hearing instrument 102A to generate an audible and/or tactile indication to direct the user to insert in-ear assembly 116A of hearing instrument 102A further into the ear canal of user 104. In some examples, processing system 114 may cause a mobile device to display an indication of whether or not to insert in-ear assembly 116A of hearing instrument 102A further into the ear canal of user 104.

In some examples, after fitting operation 400 of FIG. 4 is complete, microphone 110A may be detached from in-ear assembly 116A. This may reduce the size and weight of in-ear assembly 116A, which may increase the comfort of the fit of in-ear assembly 116A and reduce any occlusion that may be caused by having additional components in the ear canal of user 104. In some examples, microphone 110A may subsequently be reattached to in-ear assembly 116A for future fitting operations. In other examples, microphone 110A may remain within or attached to in-ear assembly 116A during normal use of hearing instrument 102A.

In some examples, the techniques of this disclosure may be used to monitor positions of in-ear assemblies 116 of hearing instruments 102 over time, e.g., during daily wear or over the course of days, weeks, months, years, etc. That is, rather than only performing fitting operation 400 when user 104 is first using hearing instruments 102, fitting operation 400 may be performed for ongoing monitoring of the levels of insertion of hearing instruments 102 during wear (e.g., after user 104 has inserted in-ear assemblies 116 of hearing instruments 102 to a proper depth of insertion). Continued monitoring of the insertion levels of in-ear assemblies 116 of hearing instruments 102 may be useful for users for whom in-ear assemblies 116 of hearing instruments 102 tend to wiggle out. In such cases, processing system 114 may automatically initiate fitting operation 400 and, if an in-ear assembly of a hearing instrument is not at a proper depth of insertion, processing system 114 may generate an indication (e.g., an audible, tactile, visual indication) instructing user 104 to push the in-ear assembly further into the user's ear canal. In some examples, processing system 114 may be configured such that, as part of generating the indication based on the depth of insertion, the one or more processors causing a notification to appear (e.g., on a display screen of a device) indicating the depth of insertion.

Furthermore, in some examples, processing system 114 may track the number of times and/or frequency with which an in-ear assembly of a hearing instrument goes from a proper depth of insertion to an improper depth of insertion during use. If this occurs a sufficient number of times and/or at a specific rate, processing system 114 may perform various actions. For example, processing system 114 may generate an indication to user 104 recommending user 104 perform an action, such as change a size of an earbud of the in-ear assembly, or consult a hearing specialist or audiologist to determine if an alternative (e.g., custom, semi-custom, etc.) earmold may provide greater benefit to user 104. Thus, in some examples, processing system 114 may generate, based at least in part on the depth of insertion of in-ear assembly 116A of hearing instrument 102A into the ear canal of user 104, an indication that user 104 should change a size of an earbud of the in-ear assembly 116A of hearing instrument 102A. Furthermore, in some examples, if processing system 114 receives an indication that user 104 indicated (to the hearing instruments 102, via an application, or other device) that user 104 is interested in pursuing this option, processing system 114 may connect to the Internet/location services to find an appropriate healthcare provider in an area of user 104.

In some examples where fitting operation 400 is performed periodically, user 104 may simply need to be reminded of proper insertion. However, changes to the determined levels of insertion of in-ear assemblies 116 of hearing instruments 102 may signify that a change has occurred with the hearing status of user 104. Certain conditions, especially those causing conductive hearing losses, can affect the impedance of the user's ears and therefore may change the measured response to the sound generated be speakers 108. In this case, if user 104 has been instructed to push in one of in-ear assemblies 116 further into an ear canal of user 104, and a repeat measurements suggests that the in-ear assembly is still not at a proper depth of insertion, processing system 114 may output, for presentation to user 104, an indication regarding a potential change to the hearing status of user 104. For instance, processing system 114 may output, for presentation to user 104, one or more follow-up questions (e.g., "Do you currently have a cold or an ear infection?" "Have you recently had any ear surgeries?" etc.). Thus, in some examples, processing system 114 may generate, based at least in part on the depth of insertion of in-ear assembly 116A of hearing instrument 102A into the ear canal of user 104, an indication that a potential change to a hearing status of user 104.

If processing system 114 receives indications of user responses to such questions that indicate potential changes to the hearing status of user 104 (e.g., "yes," to any of the example questions above), processing system 114 may generate output recommending that user 104 consult a healthcare provider, such as a medical doctor. Furthermore, in this example, if processing system 114 receives indications of user input to questions indicating that changes to the hearing status of user 104 have not occurred (e.g., if user 104 answers "no" to the example questions mentioned above), processing system 114 may generate output recommending cleaning of hearing instruments 102 and repeating fitting operation 400, or refer user 104 to a hearing instrument specialist/audiologist to determine whether there is something else wrong with one or more of hearing instruments 102. In this way, the techniques of this disclosure may both serve to improve the insertion of hearing instruments 102 and to monitor changes in conductive hearing pathways over time. In this disclosure, changes in conductive hearing pathways may refer to any physical changes in the external or middle ear that could signify a change in the individual's hearing and/or the need for follow-up with a medical professional. Monitoring for such changes may be especially helpful for purchasers of over-the-counter hearing instruments because this population is unlikely to have seen a doctor before purchasing their hearing instruments.

In some examples, the indication may advise user 104 to consult a hearing professional. In other words, as part of generating the indication, processing system 114 may generate, based at least in part on the depth of insertion of in-ear assembly 116A of hearing instrument 102A into the ear canal of user 104, an indication that user 104 should consult a hearing professional. In some such examples, processing system 114 may make a determination to generate the indication that user 104 should consult a hearing professional in response to determining that user 104 should change a size or style of an earbud of in-ear assembly 116A of hearing instrument 102A. Processing system 114 may determine that user 104 should change a size or style of the earbud if user 104 is consistently unable to insert in-ear assembly 116A past a particular depth (e.g., because the earbud is too large) or user 104 consistently over-inserts in-ear assembly 116A (e.g., because the earbud is too small) or a depth of in-ear assembly 116A changes during use (e.g., because the earbud is too small to hold in-ear assembly 116A in place during use), or in response to other conditions. In some examples, processing system 114 may make a determination to generate the indication that user 104 should consult a hearing professional in response to determining that there is a potential change to a hearing status of user 104. In some examples, processing system 114 may make a determination to generate the indication that user 104 should consult a hearing professional when user 104 has failed to insert in-ear assembly 116A of hearing instrument 102A into the ear canal of user 104 a sufficient number of times.

Furthermore, in some examples, processing system 114 may access one or more online services via a communication system (e.g., the Internet) to identify an appropriate hearing professional for user 104. For example, processing system 114 may automatically interact with an online search engine to identify an appropriate hearing professional for user 104. In some examples, processing system 114 may interact with an online registry of qualified hearing professionals to identify the appropriate hearing professional. The indication generated by processing system 114 may include information indicating the identified hearing professional. In some examples, processing system 114 may initiate a voice communication session between a computing system associated with a hearing professional and a computing system (e.g., hearing instruments 102, computing system 106, etc.) associated with user 104.

In some examples, processing system 114 may provide, to a computing system associated with a hearing professional, information related to the suspected insertion problems being experienced by user 104. For example, processing system 114 may send an email, insert a note in an electronic medical record system, or otherwise provide the information to the healthcare professional. The information provided to the healthcare professional may include data regarding the depths of insertion achieved by user 104, numbers of attempts of insert in-ear assembly 116A, average depth of insertion, detected movement of in-ear assembly 116A within the ear canal during use, a summary of suspected changes to the conductive auditory pathways, and/or other types of information.

The following is a non-limiting list of examples that may be in accordance with one or more techniques of this disclosure.

Example 1: A method for fitting a hearing instrument includes generating, by a speaker of the hearing instrument, a sound that includes a range of frequencies; measuring, by a microphone of the hearing instrument, an acoustic response to the sound; classifying, by a processing system, based on the acoustic response to the sound, a depth of insertion of an in-ear assembly of the hearing instrument into an ear canal of a user; and generating an indication based on the depth of insertion.

Example 2: The method of example 1, wherein: the method further comprises: determining, by the processing system, a notch frequency based on the acoustic response, wherein the notch frequency is a frequency in the range of frequencies having a level that is attenuated in the acoustic response relative to levels in the acoustic response of frequencies surrounding the frequency; and estimating, by the processing system, based on the notch frequency, a distance metric associated with a distance from the in-ear assembly to a tympanic membrane of the user of the hearing instrument, and classifying the depth of insertion comprises classifying, by the processing system, based on the distance metric, the level of insertion of the in-ear assembly of the hearing instrument into the ear canal of the user.

Example 3: The method of example 2, wherein classifying the depth of insertion comprises: classifying, by the processing system, based on the distance metric and a range of ear canal lengths for the user, the depth of insertion.

Example 4: The method of example 3, wherein classifying the depth of insertion comprises determining, by the processing system, that the depth of insertion is a first class or a second class depending on whether the distance is within a specified range, the specified range being defined by (1) an upper end of the range of ear canal lengths for the user minus a length of all or part of the in-ear assembly of the hearing instrument and (2) a lower end of the range of ear canal lengths of the user minus the length of all or part of the in-ear assembly of the hearing instrument.

Example 5: The method of any of examples 3-4, further comprising determining, by the processing system, the range of ear canal lengths for the user based on demographic data regarding the user.

Example 6: The method of example 5, further includes obtaining, by the processing system, an audio signal of a voice of the user; and determining, by the processing system, the demographic data regarding the user based on the audio signal of the voice of the user.

Example 7: The method of any of examples 2-6, wherein estimating the distance metric comprises determining, by the processing system, the distance metric associated with one-quarter wavelength of the notch frequency.

Example 8: The method of any of examples 2-7, wherein: the microphone is a first microphone, the method further comprises measuring, by a second microphone of the hearing instrument, the acoustic response to the sound; determining the notch frequency comprises determining, by the processing system, the notch frequency based on the acoustic response as measured by the first microphone and the acoustic response as measured by the second microphone.

Example 9: The method of any of examples 2-8, wherein: a shell of the in-ear assembly defines a first port and a second port, measuring the acoustic response to the sound comprises: obtaining, by the processing system, the acoustic response to the sound as measured by the microphone through the first port; and obtaining, by the processing system, the acoustic response to the sound as measured by the microphone through the second port, and determining the notch frequency comprises determining, by the processing system, the notch frequency based on the acoustic response as measured by the microphone through the first port and the acoustic response as measured by the microphone through the second port.

Example 10: The method of any of examples 1-9, wherein classifying the depth of insertion comprises: determining, by the processing system, whether the depth of insertion is in a first class or a second class, the first class corresponding to under-insertion of the in-ear assembly of the hearing instrument into the ear canal of the user, and the second class corresponding to adequate insertion of the in-ear assembly of the in-ear assembly of the hearing instrument into the ear canal of the user.

Example 11: The method of any of examples 1-10, wherein the indication instructs the user to insert the in-ear assembly of the hearing instrument further into the ear canal of the user.

Example 12: The method of any of examples 1-11, wherein the microphone is detachable from the hearing instrument.

Example 13: The method of any of examples 1-12, wherein the processing system is contained within a housing of the hearing instrument.

Example 14: The method of any of examples 1-13, further comprising determining, by the processing system, based on a history of attempts by the user to insert the in-ear assembly of the hearing instrument into the ear canal of the user, whether to initiate a process that comprises generating the sound, measuring the acoustic response, and classifying the depth of insertion.

Example 15: The method of any of examples 1-14, wherein generating the indication based on the depth of insertion comprises generating, by the processing system, based at least in part on the depth of insertion, an indication that the user should change a size of an earbud of the in-ear assembly of the hearing instrument.

Example 16: The method of any of examples 1-15, wherein generating the indication based on the depth of insertion comprises generating, by the processing system, based at least in part on the depth of insertion, an indication regarding a potential change to a hearing status of the user.

Example 17: The method of any of examples 1-16, wherein generating the indication based on the depth of insertion comprises generating, by the processing system, based at least in part on the depth of insertion, an indication that the user should consult a hearing professional.

Example 18: The method of any of examples 1-17, wherein classifying the depth of insertion comprises classifying, by the processing system, the depth of insertion based on whether the depth of insertion is appropriate for one or more sensors included in the in-ear assembly of the hearing instrument.

Example 19: The method of any of examples 1-18, wherein the method comprises: determining, by the processing system, whether an initiation event has occurred; and initiating a fitting process in response to the initiation event, wherein the fitting process comprises generating the sound, measuring the acoustic response, and classifying the depth of insertion into the ear canal of the user.

Example 20: The method of example 19, wherein the initiation event is one or more of: removal of the hearing instrument from a charger, contact of the in-ear assembly of the hearing instrument with skin, detecting that the hearing instrument is on an ear of the user, or input from the user.

Example 21: The method of any of examples 1-20, wherein generating the indication based on the depth of insertion comprises causing a notification to appear indicating the depth of insertion.

Example 22: The method of any of examples 1-20, further includes determining, based on the acoustic response to the sound, whether the in-ear assembly of the hearing instrument is inserted into a specific ear of the user.

Example 23: A system includes a speaker of a hearing instrument, the speaker configured to generate a sound that includes a range of frequencies; a microphone of the hearing instrument, wherein the microphone is configured to measure an acoustic response to the sound; and one or more processors implemented in circuitry, the one or more processors configured to: classify, based on the acoustic response to the sound, a depth of insertion of an in-ear assembly of the hearing instrument into an ear canal of a user; and generate an indication based on the depth of insertion.

Example 24: The system of example 23, wherein the one or more processors are further configured to: determine a notch frequency based on the acoustic response, wherein the notch frequency is a frequency in the range of frequencies that has a level in the acoustic response that is attenuated relative to levels in the acoustic response of frequencies surrounding the frequency; estimate, based on the notch frequency, a distance metric associated with a distance from the in-ear assembly to a tympanic membrane of the user of the hearing instrument, and classify, based on the distance metric, the depth of insertion.

Example 25: The system of example 24, wherein the one or more processors are configured to classify, based on the distance metric and a range of ear canal lengths for the user, the depth of insertion.

Example 26: The system of example 25, wherein the one or more processors are configured such that, as part of classifying the depth of insertion, the one or more processors determine that the depth of insertion is a first class or a second class depending on whether the distance is within a specified range, the specified range being defined by (1) an upper end of the range of ear canal lengths for the user minus a length of all or part of an in-ear assembly of the hearing instrument and (2) a lower end of the range of ear canal lengths of the user minus the length of all or part of the in-ear assembly of the hearing instrument.

Example 27: The system of any of examples 25-26, wherein the one or more processors are further configured to determine the range of ear canal lengths for the user based on demographic data regarding the user.

Example 28: The system of example 27, wherein the one or more processors are further configured to: obtain an audio signal of a voice of the user; and determine the demographic data regarding the user based on the audio signal of the voice of the user.

Example 29: The system of any of examples 24-28, wherein the one or more processors are configured such that, as part of estimating the distance metric, the one or more processors determine the distance metric associated with one-quarter wavelength of the notch frequency.

Example 30: The system of any of examples 24-29, wherein: the microphone is a first microphone, the hearing instrument includes a second microphone, the one or more processors are further configured to obtain the acoustic response to the sound as measured by the second microphone of the hearing instrument, and the one or more processors are configured to determine the notch frequency based on the acoustic response as measured by the first microphone and the acoustic response as measured by the second microphone.

Example 31: The system of any of examples 24-30, wherein: a shell of the in-ear assembly defines a first port and a second port, the one or more processors are further configured to: obtain the acoustic response to the sound as measured by the microphone through the first port; obtain the acoustic response to the sound as measured by the microphone through the second port, and the one or more processors are configured to determine the notch frequency based on the acoustic response as measured by the microphone through the first port and the acoustic response as measured by the microphone through the second port.

Example 32: The system of any of examples 23-31, wherein the one or more processors are configured such that, as part of classifying the depth of insertion, the one or more processors: determine whether the depth of insertion is in a first class or a second class, the first class corresponding to under-insertion of the in-ear assembly of the hearing instrument into the ear canal of the user, the second class corresponding to adequate insertion of the in-ear assembly of the hearing instrument into the ear canal of the user.

Example 33: The system of any of examples 23-32, wherein the indication instructs the user to insert the in-ear assembly of the hearing instrument further into the ear canal of the user.

Example 34: The system of any of examples 23-33, wherein the microphone is detachable from the hearing instrument.

Example 35: The system of any of examples 23-34, wherein the system comprises a housing of the hearing instrument that contains the one or more processors.

Example 36: The system of any of examples 23-35, wherein the one or more processors are further configured to determine, based on a history of attempts by the user to insert the in-ear assembly of the hearing instrument into the ear canal of the user, whether to initiate a process that comprises generating the sound, measuring the acoustic response, and classifying the depth of insertion.

Example 37: The system of any of examples 23-36, wherein the one or more processors are configured such that, as part of generating the indication based on the depth of insertion, the one or more processors generate, based at least in part on the depth of insertion, an indication that the user should change a size of an earbud of the in-ear assembly of the hearing instrument.

Example 38: The system of any of examples 23-37, wherein the one or more processors are configured such that, as part of generating the indication based on the depth of insertion, the one or more processors generate, based at least in part on the depth of insertion, an indication regarding a potential change to a hearing status of the user.

Example 39: The system of any of examples 23-38, wherein the one or more processors are configured such that, as part of generating the indication based on the depth of insertion, the one or more processors generate, based at least in part on the depth of insertion, an indication that the user should consult a hearing professional.

Example 40: The system of any of examples 23-39, wherein the one or more processors are configured such that, as part of classifying the depth of insertion, the one or more processors classify the depth of insertion based on whether the depth of insertion is appropriate for one or more sensors included in the in-ear assembly of the hearing instrument.

Example 41: The system of any of examples 23-40, wherein the one or more processors are further configured to: determine whether an initiation event has occurred; and initiate a fitting process in response to the initiation event, wherein the fitting process comprises generating the sound, measuring the acoustic response, and classifying the depth of insertion.

Example 42: The system of example 41, wherein the initiation event is one or more of: removal of the hearing instrument from a charger, contact of the in-ear assembly of the hearing instrument with skin, detecting that the hearing instrument is on an ear of the user, or input from the user.

Example 43: The system of any of examples 23-42, wherein the one or more processors are configured such that, as part of generating the indication based on the depth of insertion, the one or more processors causing a notification to appear indicating the depth of insertion.

Example 44: The system of any of examples 23-43, wherein the one or more processors are further configured to: determine, based on the acoustic response to the sound, whether the in-ear assembly of the hearing instrument is inserted into a specific ear of the user.

Example 45: A method for fitting a hearing instrument includes classifying, by a processing system, based on an acoustic response measured by a microphone of the hearing instrument to a sound generated by a speaker of the hearing instrument, a depth of insertion of an in-ear assembly of the hearing instrument into an ear canal of a user, wherein the sound includes a range of frequencies; and generating an indication based on the depth of insertion.

Example 46: The method of example 45, further comprising the methods of any of examples 1-22.

Example 47: A computer-readable medium having instructions stored thereon that, when executed, cause one or more processors to perform the methods of any of examples 1-22 or 45-46.

Example 48: A system comprising means for performing the methods of any of examples 1-22 or 45-46.

In this disclosure, ordinal terms such as "first," "second," "third," and so on, are not necessarily indicators of positions within an order, but rather may be used to distinguish different instances of the same thing. Examples provided in this disclosure may be used together, separately, or in various combinations. Furthermore, with respect to examples that involve personal data regarding a user, it may be required that such personal data only be used with the permission of the user. Furthermore, it is to be understood that discussion in this disclosure of hearing instrument 102A (including components thereof, such as in-ear assembly 116A, speaker 108A, microphone 110A, processors 112A, etc.) may apply with respect to hearing instrument 102B.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

In one or more examples, the functions described may be implemented in hardware, software, firmware, or any combination thereof. If implemented in software, the functions may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processing circuits to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, cache memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Functionality described in this disclosure may be performed by fixed function and/or programmable processing circuitry. For instance, instructions may be executed by fixed function and/or programmable processing circuitry. Such processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules. Also, the techniques could be fully implemented in one or more circuits or logic elements. Processing circuits may be coupled to other components in various ways. For example, a processing circuit may be coupled to other components via an internal device interconnect, a wired or wireless network connection, or another communication medium.

The techniques of this disclosure may be implemented in a wide variety of devices or apparatuses, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a hardware unit or provided by a collection of interoperative hardware units, including one or more processors as described above, in conjunction with suitable software and/or firmware.

Various examples have been described. These and other examples are within the scope of the following claims.

What is claimed is:

1. A method for fitting a hearing instrument, the method comprising:

generating, by a speaker included in an in-ear assembly of the hearing instrument, a sound that includes a range of frequencies;

measuring, by a microphone included in the in-ear assembly of the hearing instrument, an acoustic response to the sound;

classifying, by a processing system of the hearing instrument, based on the acoustic response to the sound, a depth of insertion of the in-ear assembly of the hearing instrument into an ear canal of a user; and generating an indication based on the depth of insertion.

2. The method of claim 1, wherein:

the method further comprises:

determining, by the processing system, a notch frequency based on the acoustic response, wherein the notch frequency is a frequency in the range of frequencies having a level that is attenuated in the acoustic response relative to levels in the acoustic response of frequencies surrounding the frequency; and estimating, by the processing system, based on the notch frequency, a distance metric associated with a distance from the in-ear assembly to a tympanic membrane of the user of the hearing instrument, and classifying the depth of insertion comprises classifying, by the processing system, based on the distance metric, the level of insertion of the in-ear assembly of the hearing instrument into the ear canal of the user.

3. The method of claim 2, wherein classifying the depth of insertion comprises: classifying, by the processing system, based on the distance metric and a range of ear canal lengths for the user, the depth of insertion.

4. The method of claim 3, wherein classifying the depth of insertion comprises determining, by the processing system, that the depth of insertion is a first class or a second class depending on whether the distance is within a specified range, the specified range being defined by (1) an upper end of the range of ear canal lengths for the user minus a length of all or part of the in-ear assembly of the hearing instrument and (2) a lower end of the range of ear canal lengths of the user minus the length of all or part of the in-ear assembly of the hearing instrument.

5. The method of claim 2, wherein:

the microphone is a first microphone, the method further comprises measuring, by a second microphone of the hearing instrument, the acoustic response to the sound, and determining the notch frequency comprises determining, by the processing system, the notch frequency based on the acoustic response as measured by the first microphone and the acoustic response as measured by the second microphone.

6. The method of claim 2, wherein:

a shell of the in-ear assembly defines a first port and a second port, measuring the acoustic response to the sound comprises:

obtaining, by the processing system, the acoustic response to the sound as measured by the microphone through the first port; and obtaining, by the processing system, the acoustic response to the sound as measured by the microphone through the second port, and determining the notch frequency comprises determining, by the processing system, the notch frequency based on the acoustic response as measured by the microphone through the first port and the acoustic response as measured by the microphone through the second port.

7. The method of claim 1, wherein classifying the depth of insertion comprises:

determining, by the processing system, whether the depth of insertion is in a first class or a second class, the first class corresponding to under-insertion of the in-ear assembly of the hearing instrument into the ear canal of the user, and the second class corresponding to adequate insertion of the in-ear assembly of the in-ear assembly of the hearing instrument into the ear canal of the user.

8. The method of claim 1, wherein the indication instructs the user to insert the in-ear assembly of the hearing instrument further into the ear canal of the user.

9. The method of claim 1, further comprising determining, by the processing system, based on a history of attempts by the user to insert the in-ear assembly of the hearing instrument into the ear canal of the user, whether to initiate a process that comprises generating the sound, measuring the acoustic response, and classifying the depth of insertion.

10. The method of claim 1, wherein classifying the depth of insertion comprises classifying, by the processing system, the depth of insertion based on whether the depth of insertion is appropriate for one or more sensors included in the in-ear assembly of the hearing instrument.

11. The method of claim 1, further comprising determining, based on the acoustic response to the sound, whether the in-ear assembly of the hearing instrument is inserted into a left ear or right ear of the user.

12. A system comprising:

an in-ear assembly of a hearing instrument, the in-ear assembly comprising:

a speaker of a hearing instrument, the speaker configured to generate a sound that includes a range of frequencies; and a microphone of the hearing instrument, wherein the microphone is configured to measure an acoustic response to the sound; and one or more processors implemented in circuitry, the one or more processors configured to:

classify, based on the acoustic response to the sound, a depth of insertion of the in-ear assembly of the hearing instrument into an ear canal of a user; and generate an indication based on the depth of insertion.

13. The system of claim 12, wherein the one or more processors are further configured to:

determine a notch frequency based on the acoustic response, wherein the notch frequency is a frequency in the range of frequencies that has a level in the acoustic response that is attenuated relative to levels in the acoustic response of frequencies surrounding the frequency;

estimate, based on the notch frequency, a distance metric associated with a distance from the in-ear assembly to a tympanic membrane of the user of the hearing instrument, and classify, based on the distance metric, the depth of insertion.

14. The system of claim 13, wherein the one or more processors are configured to classify, based on the distance metric and a range of ear canal lengths for the user, the depth of insertion.

15. The system of claim 14, wherein the one or more processors are configured such that, as part of classifying the depth of insertion, the one or more processors determine that the depth of insertion is a first class or a second class depending on whether the distance is within a specified range, the specified range being defined by (1) an upper end of the range of ear canal lengths for the user minus a length of all or part of an in-ear assembly of the hearing instrument and (2) a lower end of the range of ear canal lengths of the user minus the length of all or part of the in-ear assembly of the hearing instrument.

16. The system of claim 13, wherein:

the microphone is a first microphone, the hearing instrument includes a second microphone, the one or more processors are further configured to obtain the acoustic response to the sound as measured by the second microphone of the hearing instrument, and the one or more processors are configured to determine the notch frequency based on the acoustic response as measured by the first microphone and the acoustic response as measured by the second microphone.

17. The system of claim 13, wherein:

a shell of the in-ear assembly defines a first port and a second port, the one or more processors are further configured to:

obtain the acoustic response to the sound as measured by the microphone through the first port;

obtain the acoustic response to the sound as measured by the microphone through the second port, and the one or more processors are configured to determine the notch frequency based on the acoustic response as measured by the microphone through the first port and the acoustic response as measured by the microphone through the second port.

18. The system of claim 12, wherein the one or more processors are configured such that, as part of classifying the depth of insertion, the one or more processors:

determine whether the depth of insertion is in a first class or a second class, the first class corresponding to under-insertion of the in-ear assembly of the hearing instrument into the ear canal of the user, the second class corresponding to adequate insertion of the in-ear assembly of the hearing instrument into the ear canal of the user.

19. The system of claim 12, wherein the indication instructs the user to insert the in-ear assembly of the hearing instrument further into the ear canal of the user.

20. The system of claim 12, wherein the one or more processors are further configured to determine, based on a history of attempts by the user to insert the in-ear assembly of the hearing instrument into the ear canal of the user, whether to initiate a process that comprises generating the sound, measuring the acoustic response, and classifying the depth of insertion.

21. The system of claim 12, wherein the one or more processors are configured such that, as part of classifying the depth of insertion, the one or more processors classify the depth of insertion based on whether the depth of insertion is appropriate for one or more sensors included in the in-ear assembly of the hearing instrument.

22. The system of claim 12, wherein the one or more processors are further configured to determine, based on the acoustic response to the sound, whether the in-ear assembly of the hearing instrument is inserted into a left ear or a right ear of the user.

* * * * *